US011206476B2

(12) United States Patent
Aase et al.

(10) Patent No.: US 11,206,476 B2
(45) Date of Patent: Dec. 21, 2021

(54) HEARING ASSISTANCE DEVICE THAT USES ONE OR MORE SENSORS TO AUTONOMOUSLY CHANGE A POWER MODE OF THE DEVICE

(71) Applicant: Eargo, Inc., Mountain View, CA (US)

(72) Inventors: Jonathan Sarjeant Aase, Sunnyvale, CA (US); Hardik Ruparel, Milpitas, CA (US); Beau Polinske, Minneapolis, MN (US); Gints Valdis Klimanis, Cupertino, CA (US)

(73) Assignee: Eargo, Inc., San Jose, CA (US)

( * ) Notice: Subject to any disclaimer, the term of this patent is extended or adjusted under 35 U.S.C. 154(b) by 0 days.

(21) Appl. No.: 16/990,774

(22) Filed: Aug. 11, 2020

(65) Prior Publication Data

US 2020/0374618 A1 Nov. 26, 2020

Related U.S. Application Data

(63) Continuation of application No. 16/256,885, filed on Jan. 24, 2019, now Pat. No. 10,771,883.

(60) Provisional application No. 62/627,578, filed on Feb. 7, 2018.

(51) Int. Cl.

| | |
|---|---|
| ***H04R 1/10*** | (2006.01) |
| ***H04R 25/00*** | (2006.01) |
| ***H04R 29/00*** | (2006.01) |

(52) U.S. Cl.

CPC ..... *H04R 1/1041* (2013.01); *H04R 1/1025* (2013.01); *H04R 25/305* (2013.01); *H04R 29/00* (2013.01)

(58) Field of Classification Search

CPC .. H04R 25/305; H04R 1/1025; H04R 1/1041; H04R 29/00

See application file for complete search history.

(56) References Cited

U.S. PATENT DOCUMENTS

| | | | | |
|---|---|---|---|---|
| 8,457,337 | B2 | 6/2013 | Michel et al. | |
| 8,577,067 | B2 | 11/2013 | Michel et al. | |
| 9,167,363 | B2 | 10/2015 | Michel et al. | |
| 9,344,819 | B2 | 5/2016 | Michel et al. | |
| 9,432,781 | B2 | 8/2016 | Herscher | |
| 9,826,322 | B2 | 11/2017 | Shen et al. | |
| 9,866,978 | B2 | 1/2018 | Michel et al. | |
| 9,936,311 | B2 | 4/2018 | Herscher | |
| 10,097,936 | B2 | 10/2018 | Barrett et al. | |
| 2014/0321682 | A1* | 10/2014 | Kofod-Hansen ..... | H04R 25/30 381/315 |
| 2016/0313404 | A1 | 10/2016 | Herscher | |

* cited by examiner

*Primary Examiner* — Regina N Holder
(74) *Attorney, Agent, or Firm* — Rutan & Tucker, LLP

(57) ABSTRACT

A device is discussed, such as the hearing assistance device itself and/or an electrical charger cooperating with the hearing assistance device. The device can have one or more accelerometers and a power control module to receive input data indicating a change in acceleration of the device over time from the one or more accelerometers in order to make a determination to autonomously change a power mode for the hearing assistance device based on at least whether the power control module senses movement of the hearing assistance device as indicated by the accelerometers.

20 Claims, 26 Drawing Sheets

HEARING ASSISTANCE DEVICE THAT USES ONE OR MORE SENSORS TO AUTONOMOUSLY CHANGE A POWER MODE OF THE DEVICE

RELATED APPLICATIONS

This application claims priority to under 35 USC 119 and incorporates U.S. provisional patent application Ser. No. 62/627,578, titled 'A hearing assistance device that uses one or more sensors to automatically power on/power off the device' filed Feb. 7, 2018, the disclosure of which is incorporated herein by reference in its entirety.

NOTICE OF COPYRIGHT

A portion of the disclosure of this patent application contains material that is subject to copyright protection. The copyright owner has no objection to the facsimile reproduction by anyone of the software engine and its modules, as it appears in the United States Patent & Trademark Office's patent file or records, but otherwise reserves all copyright rights whatsoever.

FIELD

Embodiments of the design provided herein generally relate to hearing assist systems and methods. For example, embodiments of the design provided herein can relate to hearing aids.

BACKGROUND

Previously, a hearing aid may be powered on by sensing its removal from the charging case, and powered off by insertion into the electrical contact for the charging case. Another hearing aid powers on when an electrical contact for the battery door senses that the door is closed, and powers off when the battery door is opened. Both require a physical action from the user. When this physical action by the user is not completed the hearing aid will continue to burn battery power. In addition, the hearing aid will tend to produce feedback when it is left on a flat reflective surface (tabletop, etc.); and thus, generate an annoying sound.

SUMMARY

Provided herein in some embodiments is a hearing assistance device such as a hearing aid.

In an embodiment, the hearing assistance device may use one or more sensors, including one or more accelerometers, to recognize the device's operational status. The hearing assistance device may use one or more sensors, including one or more accelerometers, to autonomously turn power on/power off for the device.

In an embodiment, a device such as the hearing assistance device itself and/or an electrical charger cooperating with the hearing assistance device can have one or more accelerometers and a power control module to receive input data indicating a change in acceleration of the device over time from the one or more accelerometers in order to make a determination to autonomously change a power mode for the hearing assistance device based on at least whether the power control module senses movement of the hearing assistance device as indicated by the accelerometers.

These and other features of the design provided herein can be better understood with reference to the drawings, description, and claims, all of which form the disclosure of this patent application.

DRAWINGS

The drawings refer to some embodiments of the design provided herein in which.

Figure 5:
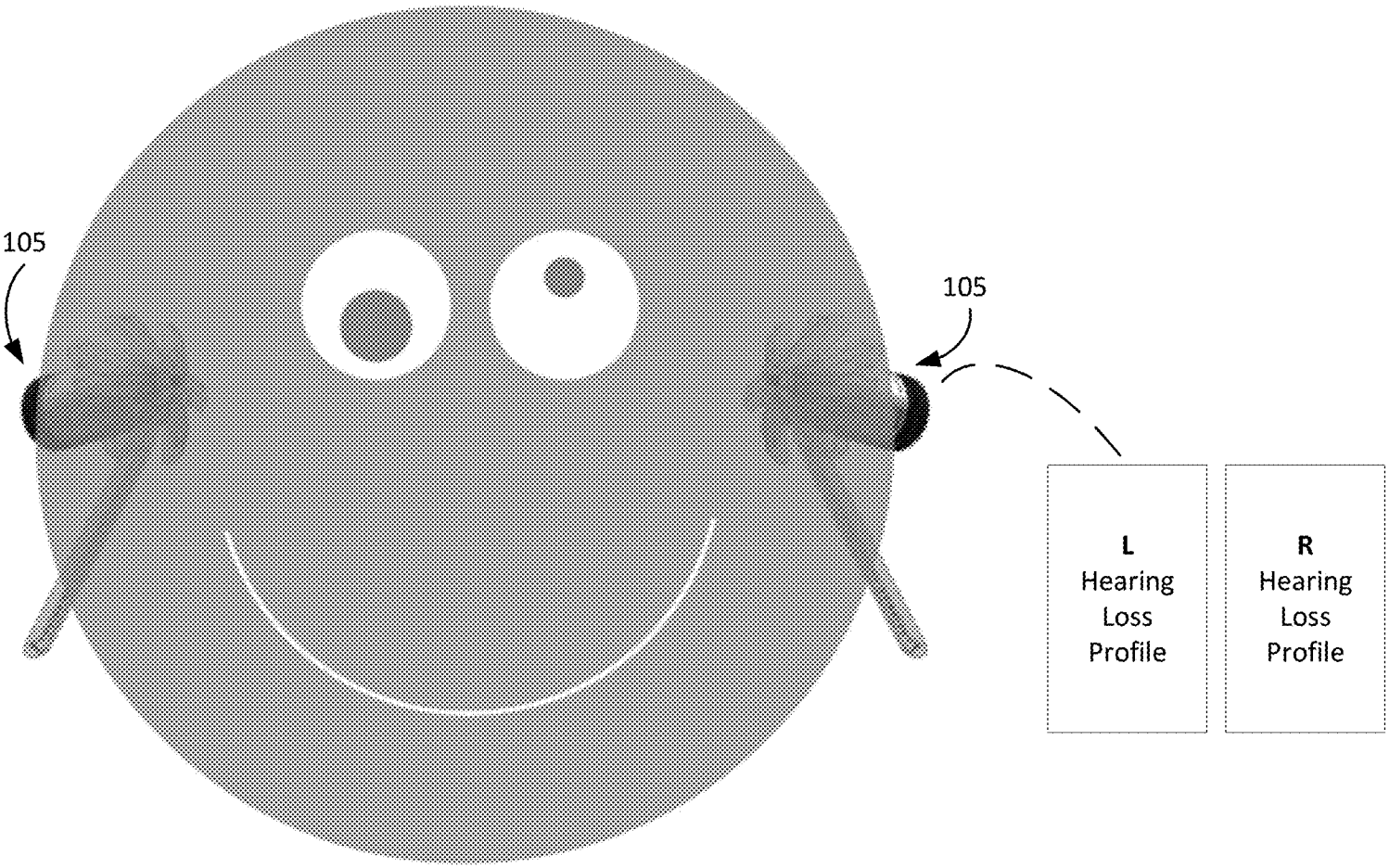

FIG. 5 illustrates an embodiment of a block diagram of example hearing assistance devices each with a power control module that may analyze input from multiple different types of sensors to autonomously recognize a current environment that the hearing assistance device is operating in and then be able to alter a threshold of an amount of vectors coming out of the accelerometers to detect the change in acceleration; and thus, change the power mode, while still being able to utilize a less error prone detection algorithm.

Figure 6:
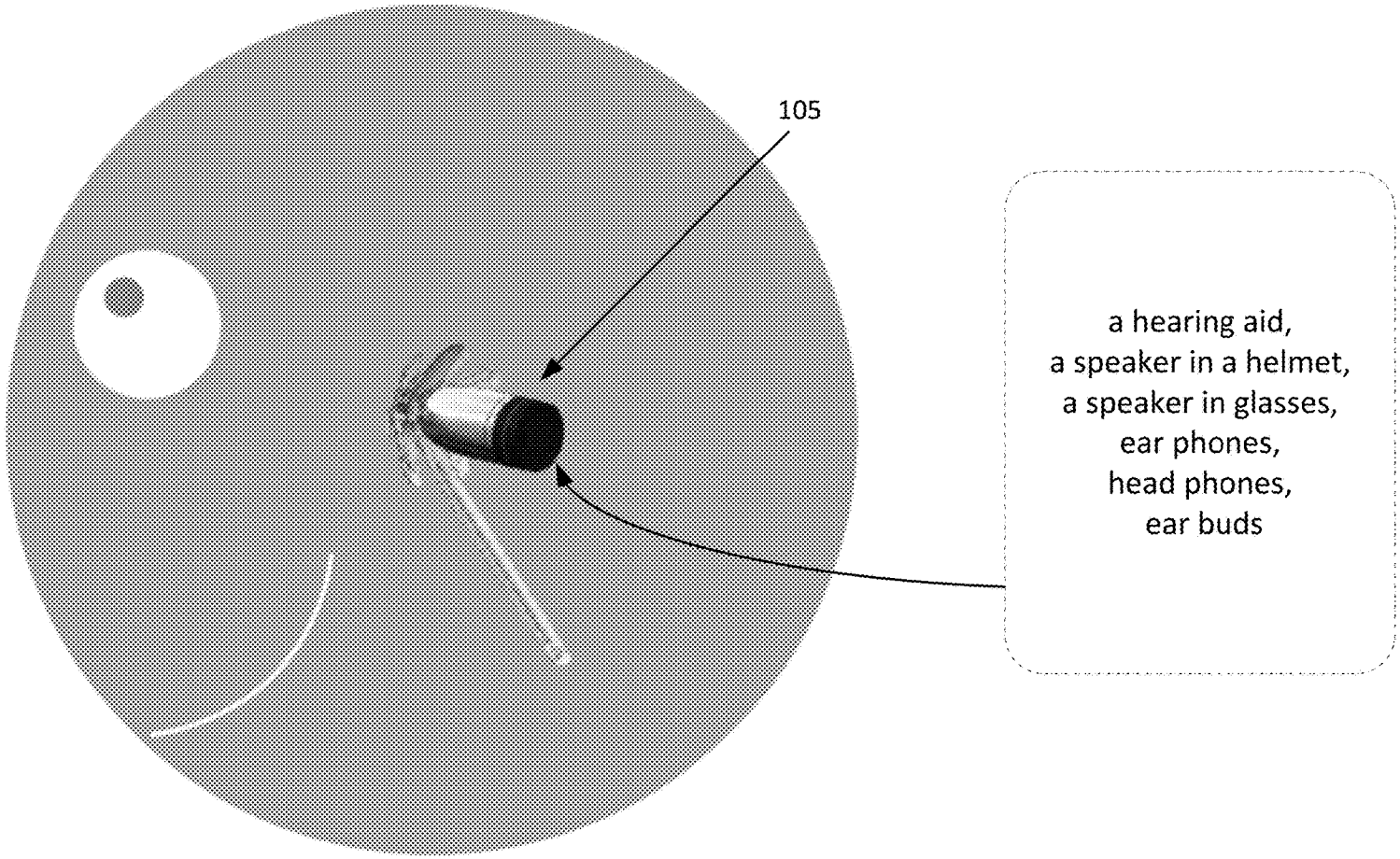

FIG. 6 illustrates an embodiment of a block diagram of an example hearing assistance device, such as a hearing aid or an ear bud.

Figure 7A:
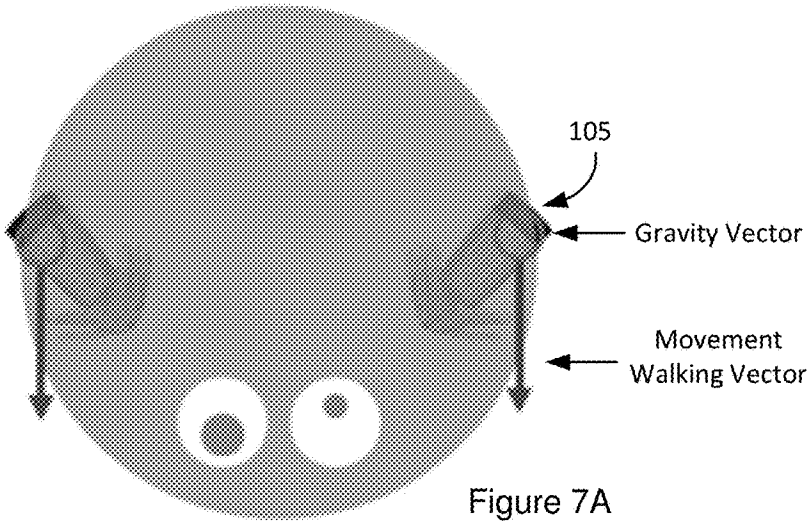
Figure 7B:
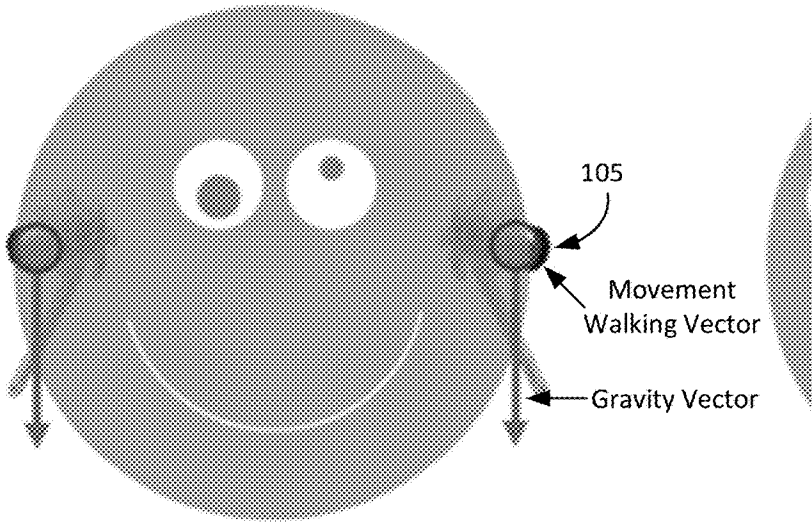
Figure 7C:
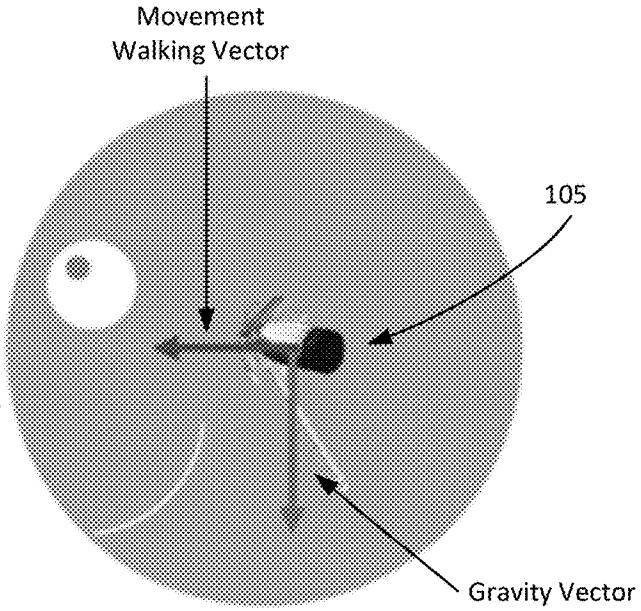

FIGS. 7A-7C illustrate an embodiment of a block diagram of an example hearing assistance device with three different views of the hearing assistance device installed.

Figure 8:
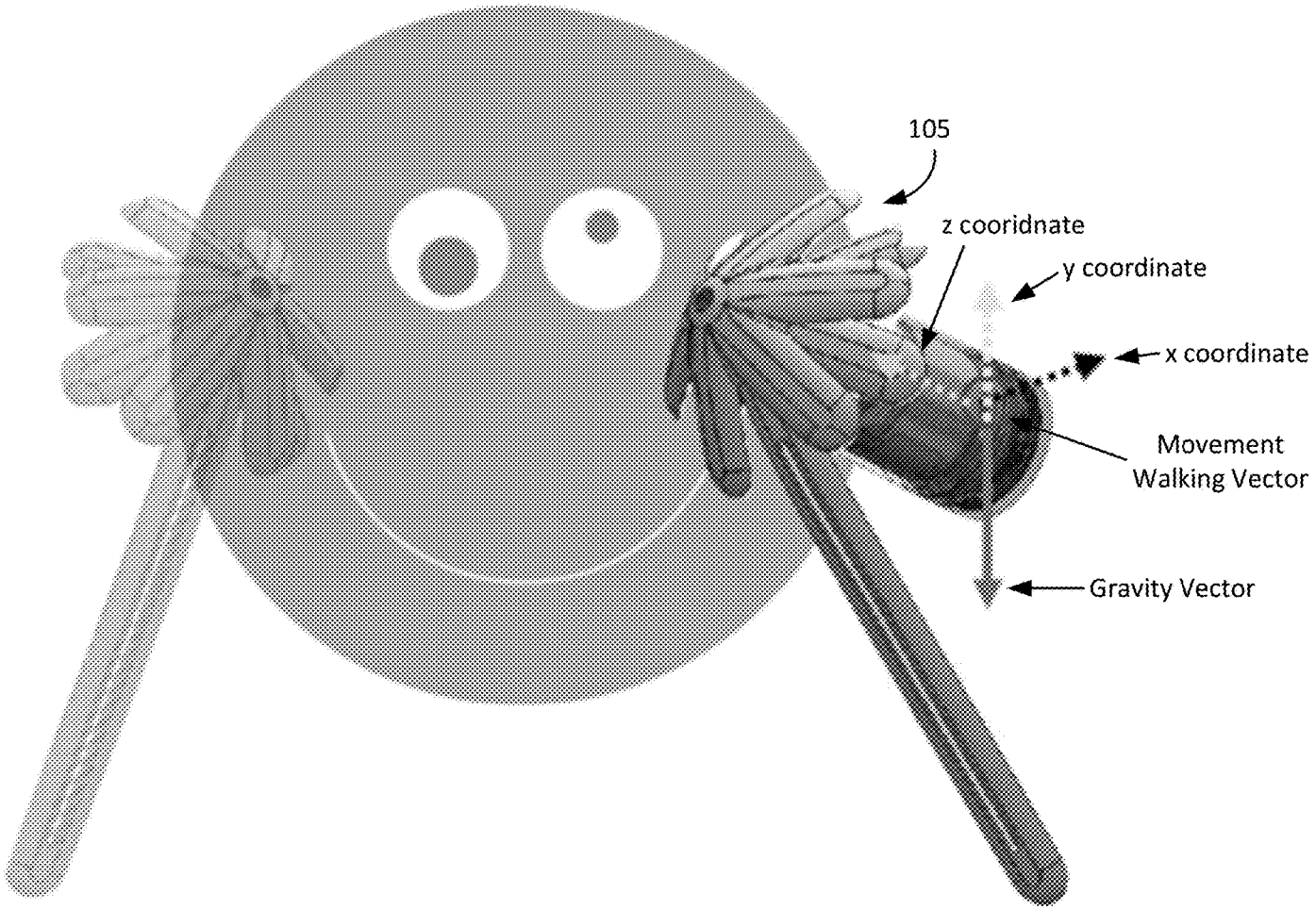

FIG. 8 shows a view of an example approximate orientation of a hearing assistance device in a head with its removal thread beneath the location of the accelerometer and extending downward on the head.

Figure 9:
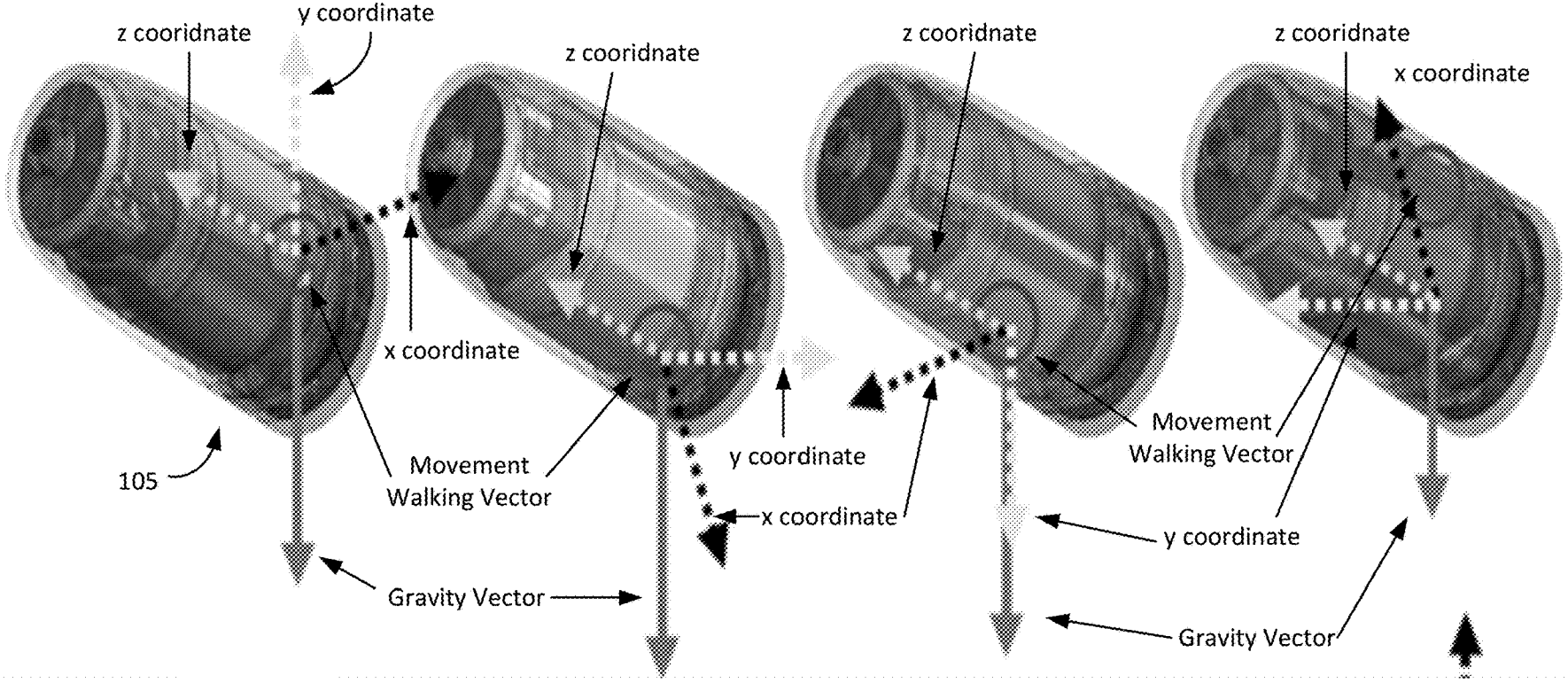

FIG. 9 shows an isometric view of the hearing assistance device inserted in the ear canal.

Figure 10:
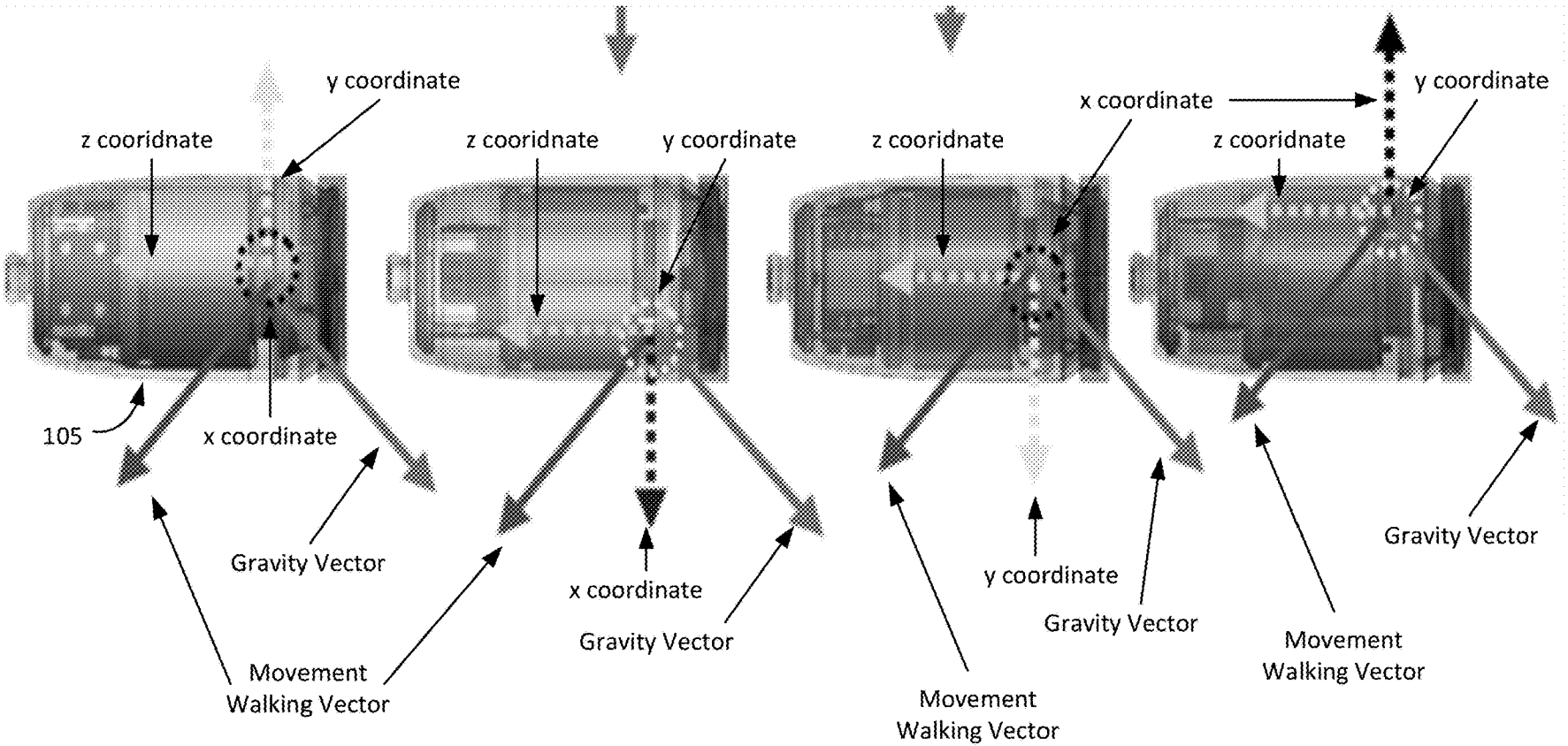

FIG. 10 shows a side view of the hearing assistance device inserted in the ear canal.

Figure 11:
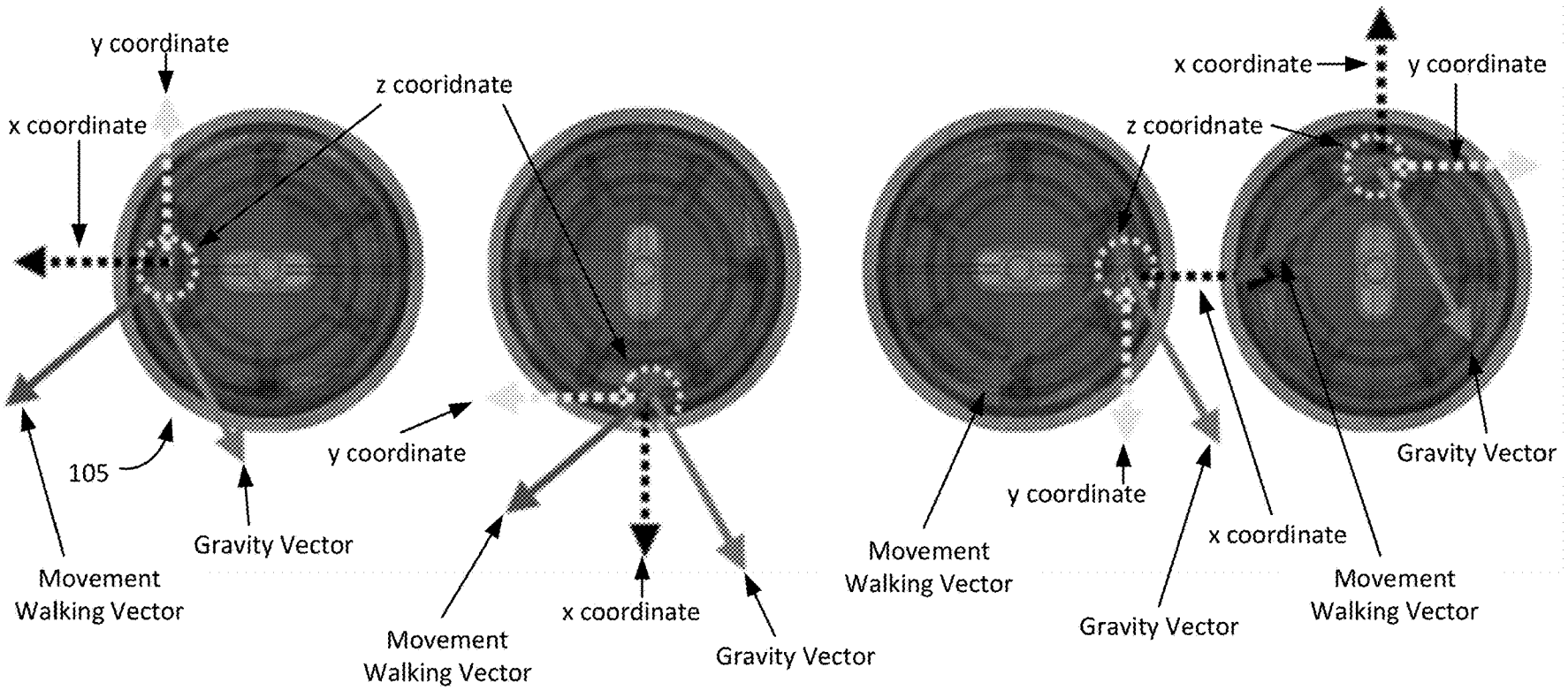

FIG. 11 shows a back view of the hearing assistance device inserted in the ear canal.

FIGS. 12A-12I illustrate an embodiment of graphs of vectors as sensed by one or more accelerometers mounted in example hearing assistance device.

Figure 13:
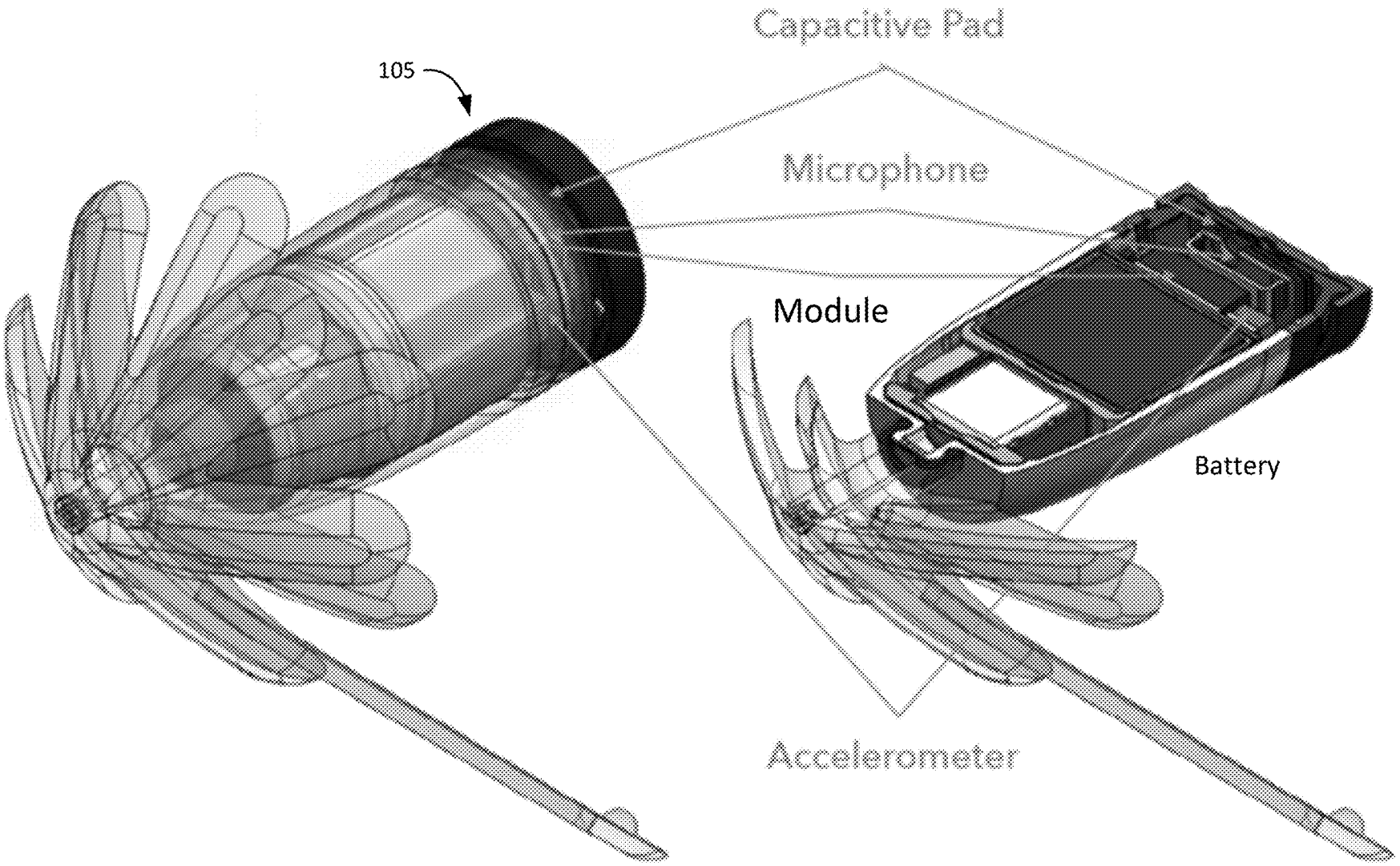

FIG. 13 illustrates an embodiment of a block diagram of an example hearing assistance device that includes an accelerometer, a microphone, a power control module with a signal processor, a battery, a capacitive pad, and other components.

Figure 14:
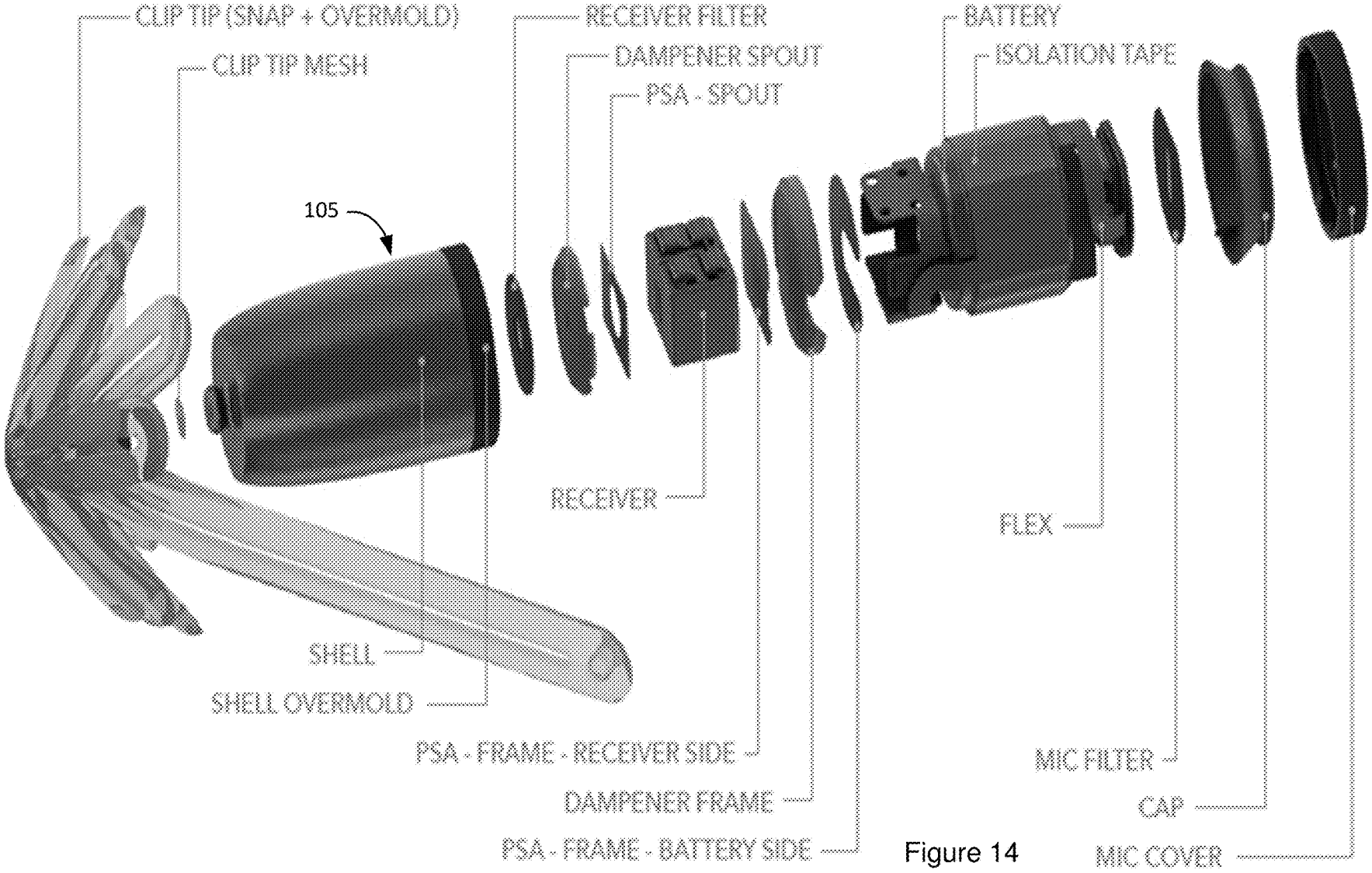

FIG. 14 illustrates an embodiment of an exploded view of an example hearing assistance device that includes an accelerometer, a microphone, a power control module, a clip tip with the snap attachment and overmold, a clip tip mesh, petals/fingers of the clip tip, a shell, a shell overmold, a receiver filter, a dampener spout, a PSA spout, a receiver, a PSA frame receive side, a dampener frame, a PSA frame battery slide, a battery, isolation tape around the compartment holding the accelerometer, other sensors, modules, etc., a flex, a microphone filter, a cap, a microphone cover, and other components.

Figure 15:
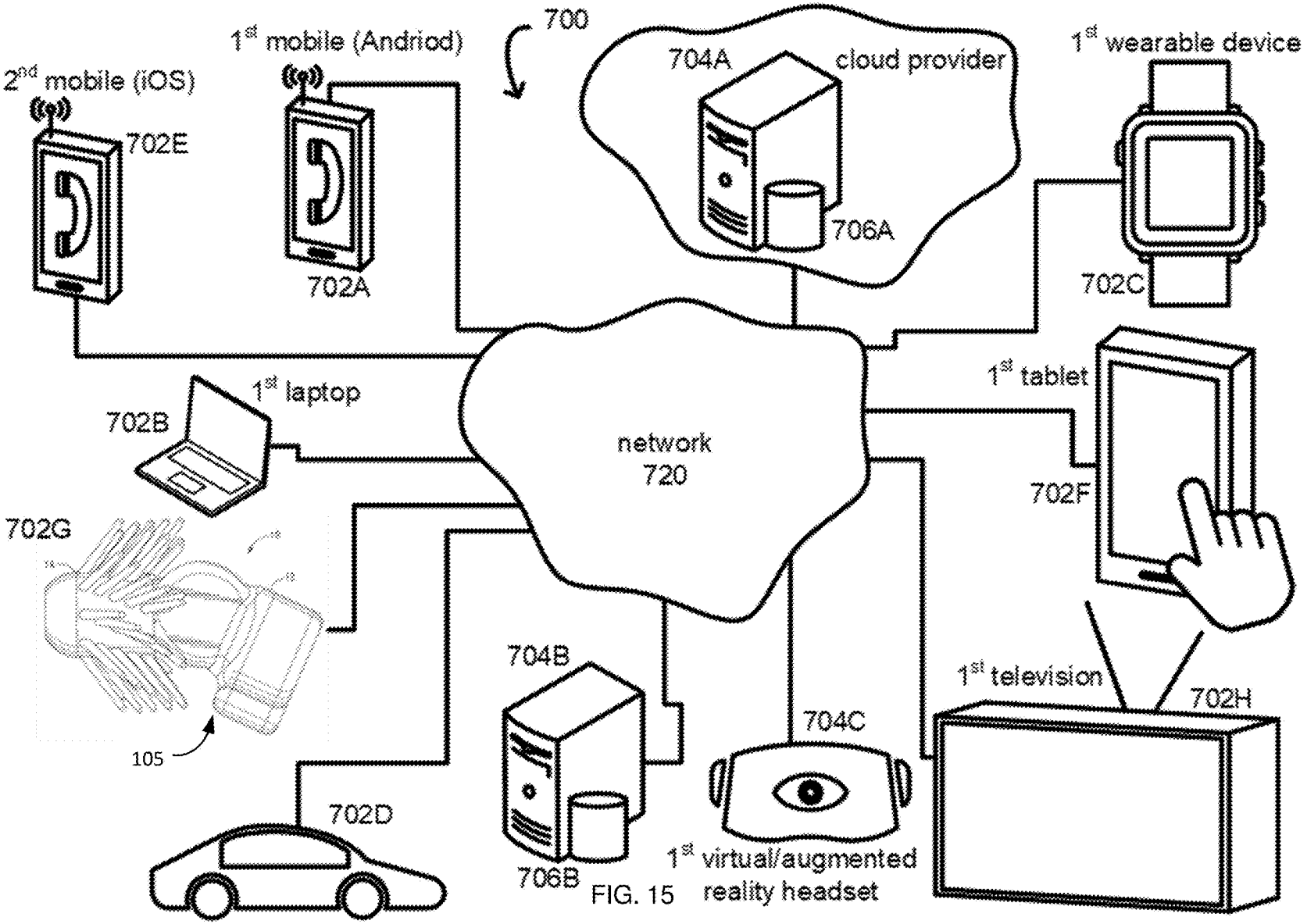

FIG. 15 illustrates a number of electronic systems including the hearing assistance device communicating with each other in a network environment.

Figure 16:
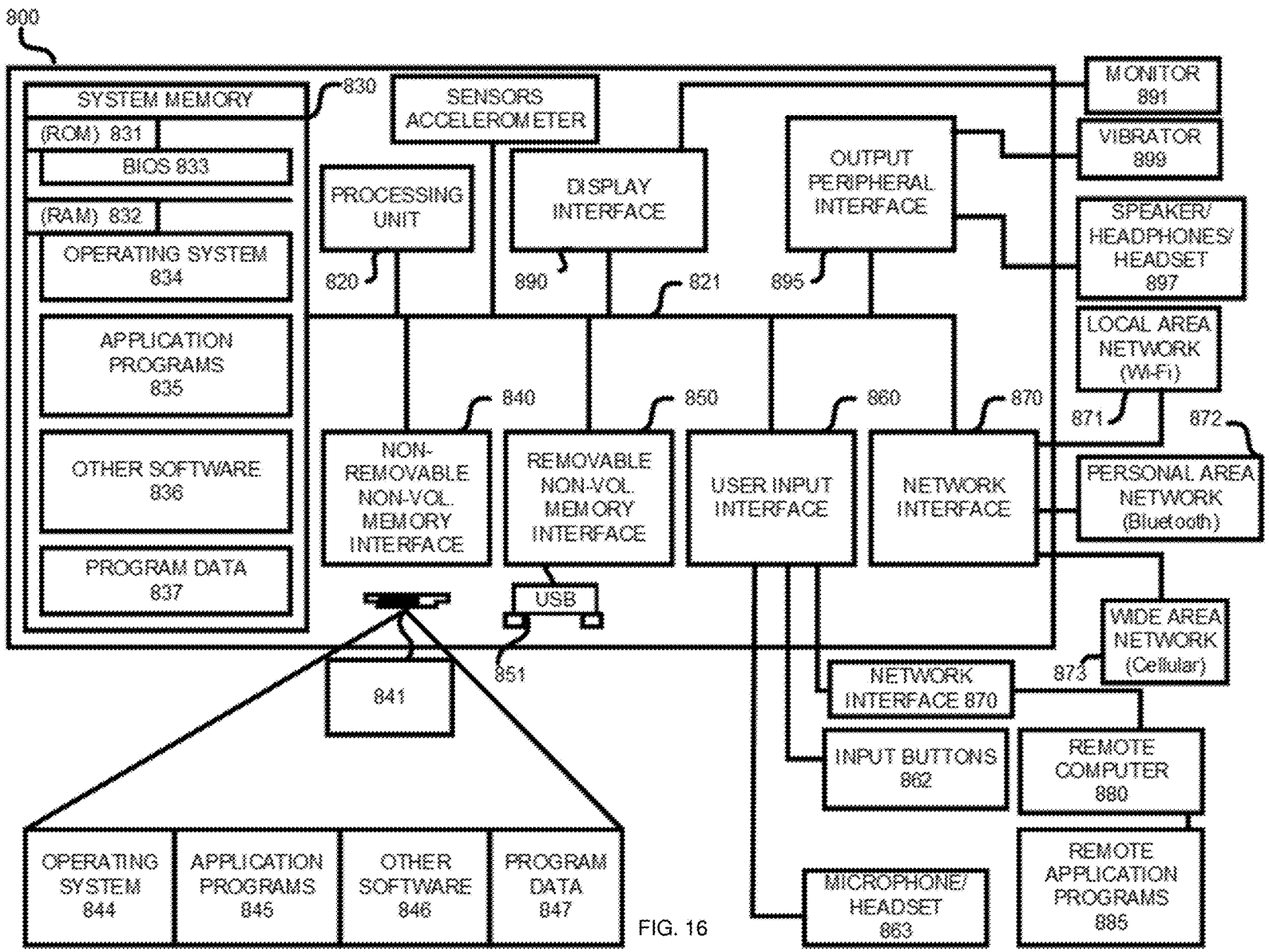

FIG. 16 illustrates a computing system that can be part of one or more of the computing devices such as the mobile phone, portions of the hearing assistance device, etc. in accordance with some embodiments.

While the design is subject to various modifications, equivalents, and alternative forms, specific embodiments thereof have been shown by way of example in the drawings and will now be described in detail. It should be understood that the design is not limited to the particular embodiments disclosed, but—on the contrary—the intention is to cover all modifications, equivalents, and alternative forms using the specific embodiments.

DESCRIPTION

In the following description, numerous specific details are set forth, such as examples of specific data signals, named components, etc., in order to provide a thorough understanding of the present design. It will be apparent, however, to one of ordinary skill in the art that the present design can be practiced without these specific details. In other instances, well known components or methods have not been described in detail but rather in a block diagram in order to avoid unnecessarily obscuring the present design. Further, specific numeric references such as first accelerometer, can be made. However, the specific numeric reference should not be interpreted as a literal sequential order but rather interpreted that the first accelerometer is different than a second accelerometer. Thus, the specific details set forth are merely exemplary. The specific details can be varied from and still be contemplated to be within the spirit and scope of the present design. The term coupled is defined as meaning connected either directly to the component or indirectly to the component through another component. Also, an application herein described includes software applications, mobile apps, programs, and other similar software executables that are either stand-alone software executable files or part of an operating system application.

FIG. 16 (a computing system) and FIG. 15 (a network system) show examples in which the design disclosed herein can be practiced. In an embodiment, this design may include a small, limited computational system, such as those found within a physically small digital hearing aid; and in addition, how such computational systems can establish and communicate via wireless a communication channel to utilize a larger, powerful computational system, such as the computational system located in a mobile device. The small computational system may be limited in processor throughput and/or memory space.

In general, a device such as the hearing assistance device itself and/or an electrical charger cooperating with the hearing assistance device can have one or more accelerometers and a power control module to receive input data indicating a change in acceleration of the device over time from the one or more accelerometers in order to make a determination to autonomously change a power mode for the hearing assistance device. The hearing assistance device can use one or more sensors types including the accelerometers to automatically change power modes of the device. The power control module can receive input data indicating a change in acceleration of the device over time from the one or more accelerometers in order to make a determination to autonomously change a power mode for the hearing assistance device based on at least whether the power control module senses movement of the hearing assistance device as indicated by the accelerometers.

Figure 2A:
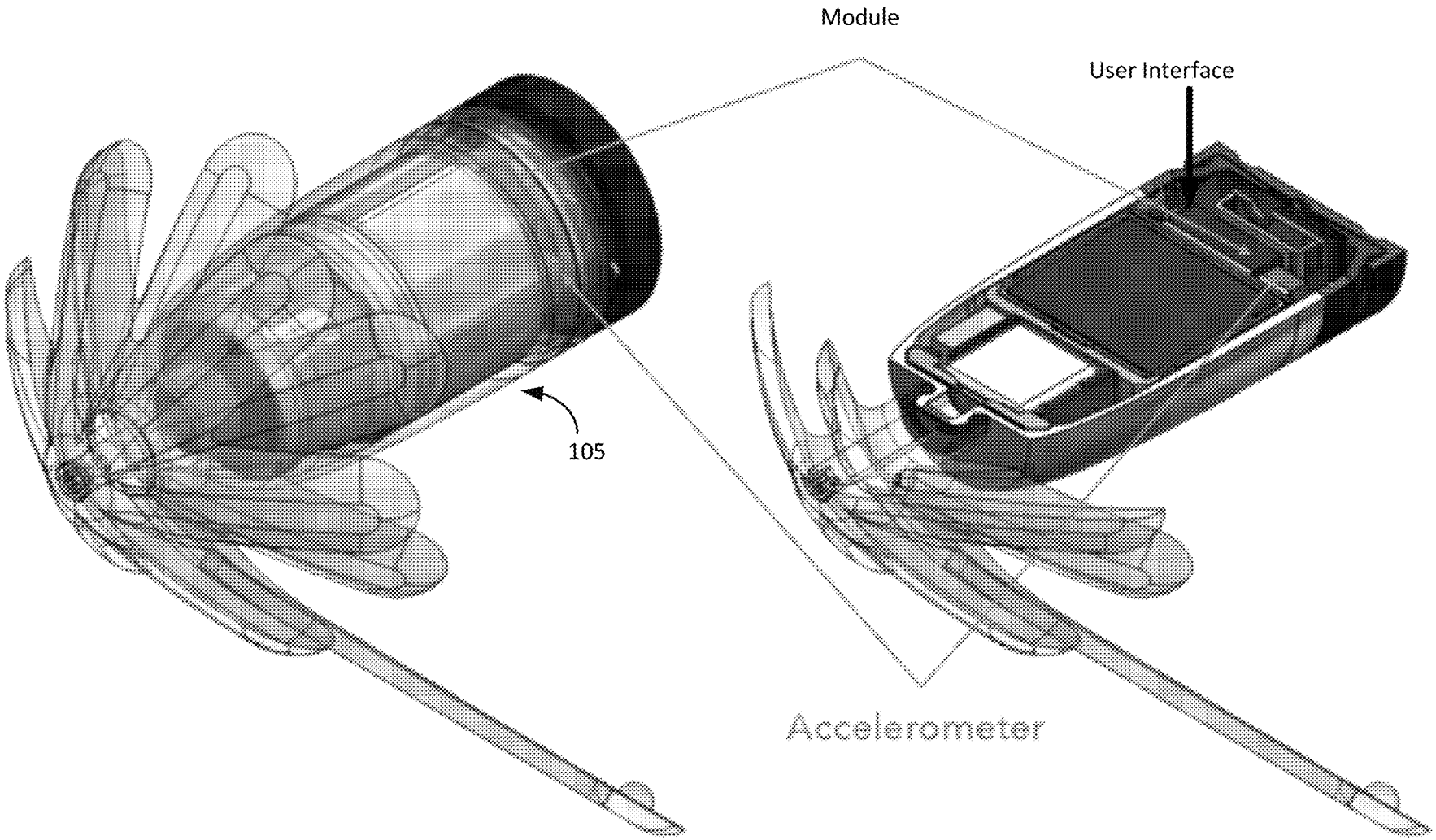
FIG. 2A illustrates an embodiment of a block diagram of an example hearing assistance device with an accelerometer, a power control module and its cut away view of the hearing assistance device.

FIG. 2A illustrates an embodiment of a block diagram of an example hearing assistance device 105 with an accelerometer, a power control module and its cut away view of the hearing assistance device. The diagram shows the location of the power control module, a memory and processors to execute the user interface, and the accelerometer both in the cutaway view of the hearing assistance device 105 and positionally in the assembled view of the hearing assistance device. The accelerometer is electrically and functionally coupled to the power control module and its signal processor, such as a digital signal processor. The power control module and the accelerometers cooperate to autonomously turn on and off the hearing assistance device.

The hearing assistance device 105 has one or more accelerometers and a user interface. The user interface may receive input data from the one or more accelerometers from user actions causing control signals as sensed by the accelerometers to trigger a power mode change for the hearing assistance device.

Figure 1:
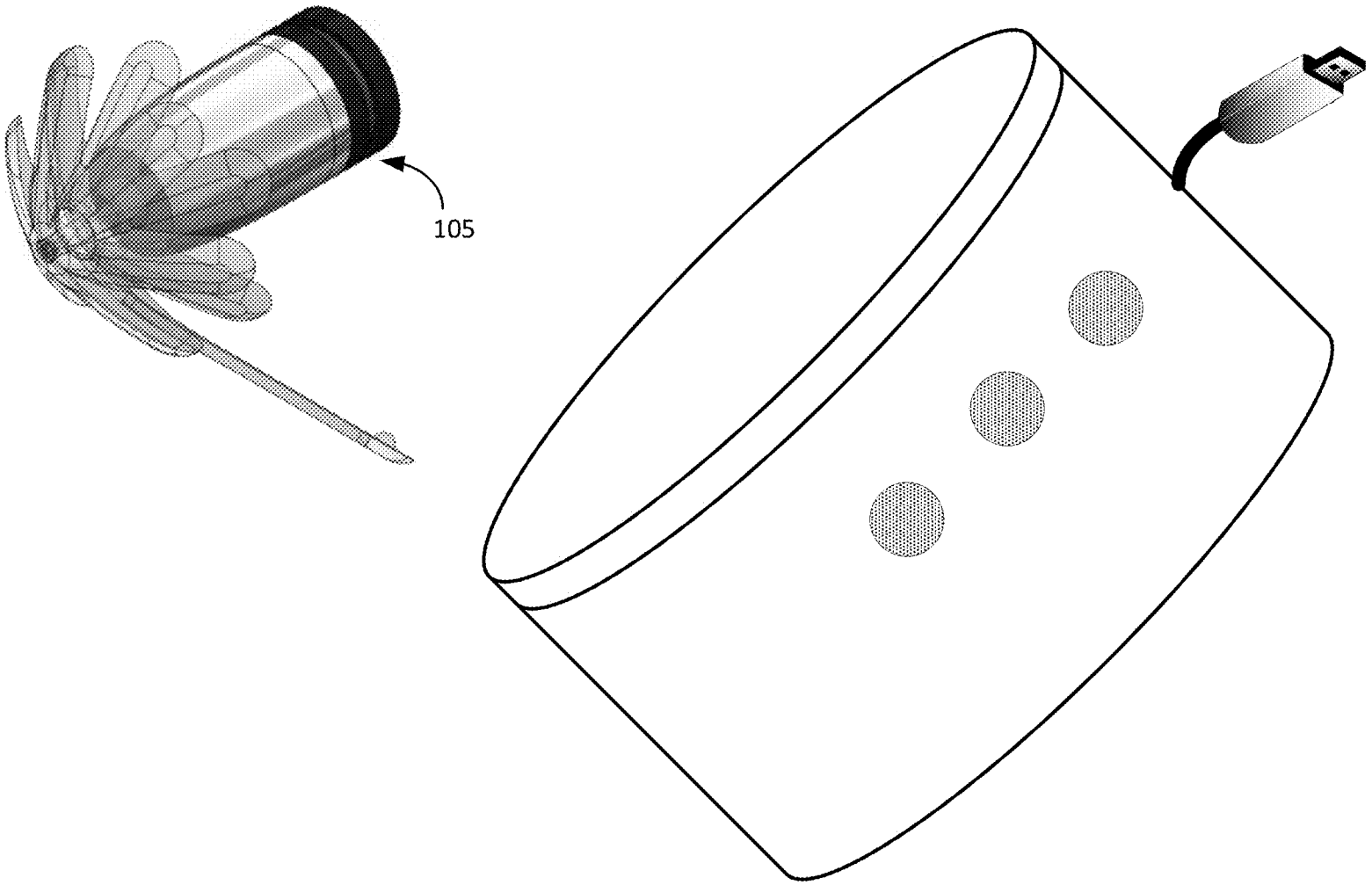
FIG. 1 Illustrates an embodiment of a block diagram of an example hearing assistance device cooperating with its electrical charger for that hearing assistance device.

Note, a device for use with a hearing assistance device 105 can be an electrical charger for the hearing assistance device 105 or the hearing assistance device 105 itself (See FIG. 1). This device can have one or more accelerometers and a power control module. The power control module can receive input data indicating a change in acceleration (e.g. jerk) of the device over time from the one or more accelerometers in order to make a determination to autonomously change a power mode, such as turn on, turn off, and low power mode, for the hearing assistance device 105 based on at least whether the power control module senses movement of the hearing assistance device 105 as indicated by the accelerometers.

Note, Jerk can be the rate of change of acceleration; that is, the time derivative of acceleration, and as such the second derivative of velocity.

The power control module may consist of executable instructions in a memory cooperating with one or more processors, hardware electronic components, or a combination of a portion made up of executable instructions and another portion made up of hardware electronic components.

In an embodiment, the power control module includes executable instructions in a memory cooperating with one or more processors. Note, when the power control module senses movement with the accelerometers, then the power control module will autonomously send a signal i) to keep the hearing assistance device 105 powered on and ii) to prompt the hearing assistance device 105 to power up if the device was in an off state or a low power state.

Automatic Power on/Power Off

The software is coded to cooperate with input data from one or more sensors to make a determination and recognize whether a device is in use or non-active. The software coded to cooperate with input data from one or more sensors may be implemented in a number of different devices such as a hearing assistance device, a watch, headphones, glasses, helmets, a charger, etc. In an example, the hearing assistance device 105 may use one or more sensors and use these sensors to control the operation of an associated device such as a charger for the hearing assistance device (See FIGS. 1-3, and 13 below). The hearing assistance device 105 may use at least an accelerometer coupled to a signal processor, such as a DSP, to sense whether the device should be powered on or off (See FIG. 2A below). The hearing assistance device 105 may use one or more sensors, including one or more accelerometers, to autonomously turn power on/power off for the device, and accomplish other new features. The hearing assistance device 105 includes a number of sensors including a small accelerometer and a signal processor, such as a DSP, mounted to the circuit board assembly.

Figure 2B:
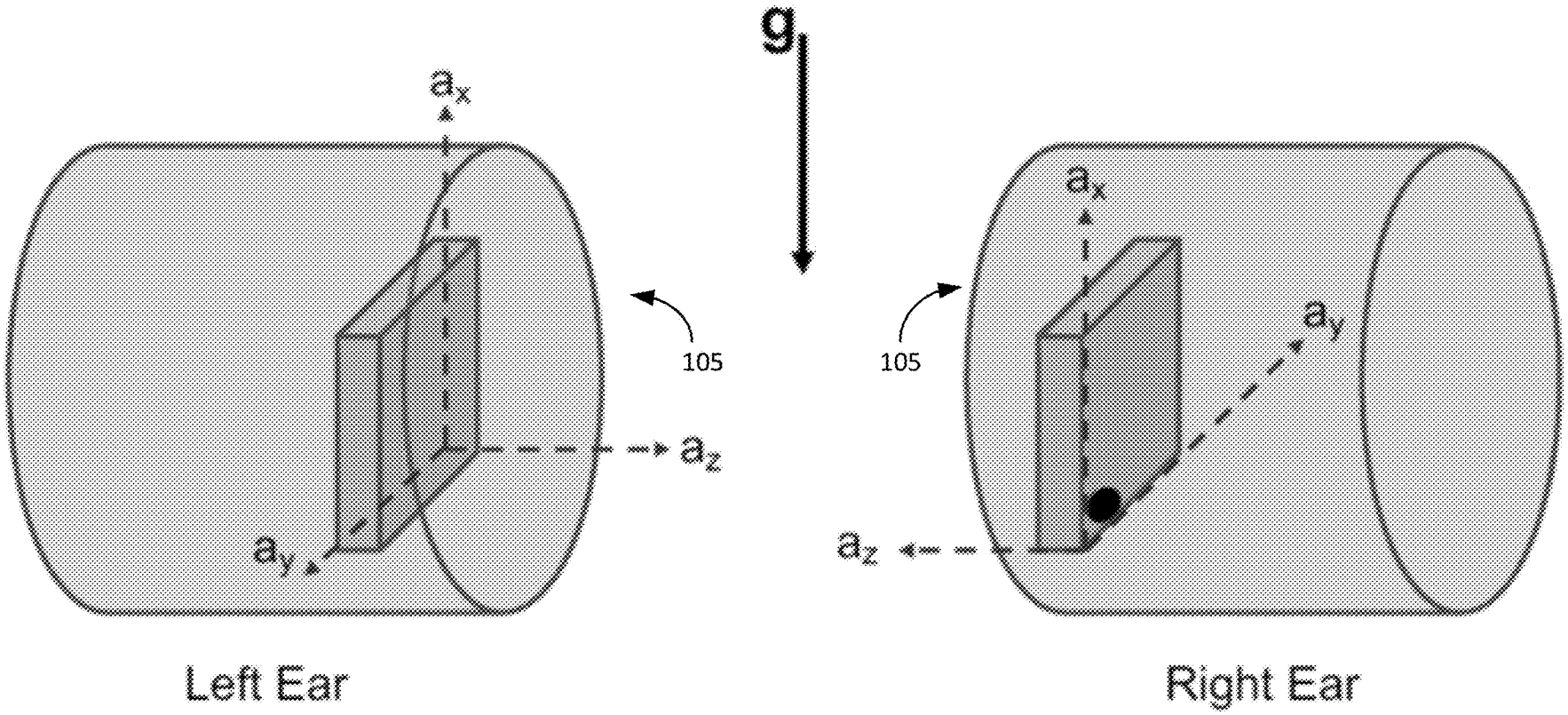
FIG. 2B illustrates an embodiment of a block diagram of an example hearing assistance device with the accelerometer axes and the accelerometer inserted in the body frame for a pair of hearing assistance devices.

FIG. 2B illustrates an embodiment of a block diagram of an example hearing assistance device 105 with the accelerometer axes and the accelerometer inserted in the body frame for a pair of hearing assistance devices.

Vectors from the one or more accelerometers are used to recognize the hearing assistance device's orientation relative to a coordinate system reflective of the user's left and right ears. One or more algorithms in a power control module analyze the vectors on the coordinate system and determine whether the device should be powered on or not. Likewise, one or more algorithms in a left/right determination module analyze the vectors on the coordinate system and determine whether the device is currently inserted in the left or right ear.

The accelerometer is assembled in a known orientation relative to the hearing assistance device. The accelerometer measures the dynamic acceleration forces caused by moving as well as the constant force of gravity. The hearing assistance device's outer form may be designed such that it is assembled into the ear canal with a repeatable orientation relative to the head coordinate system. This will allow the hearing assistance device 105 to know the gravity vector relative to the accelerometer and the head coordinate system. When the user moves around the accelerometer measures the dynamic acceleration forces caused by moving and the hearing assistance device 105 will remain powered on and/or be prompted to power up from an off state.

Figure 3:
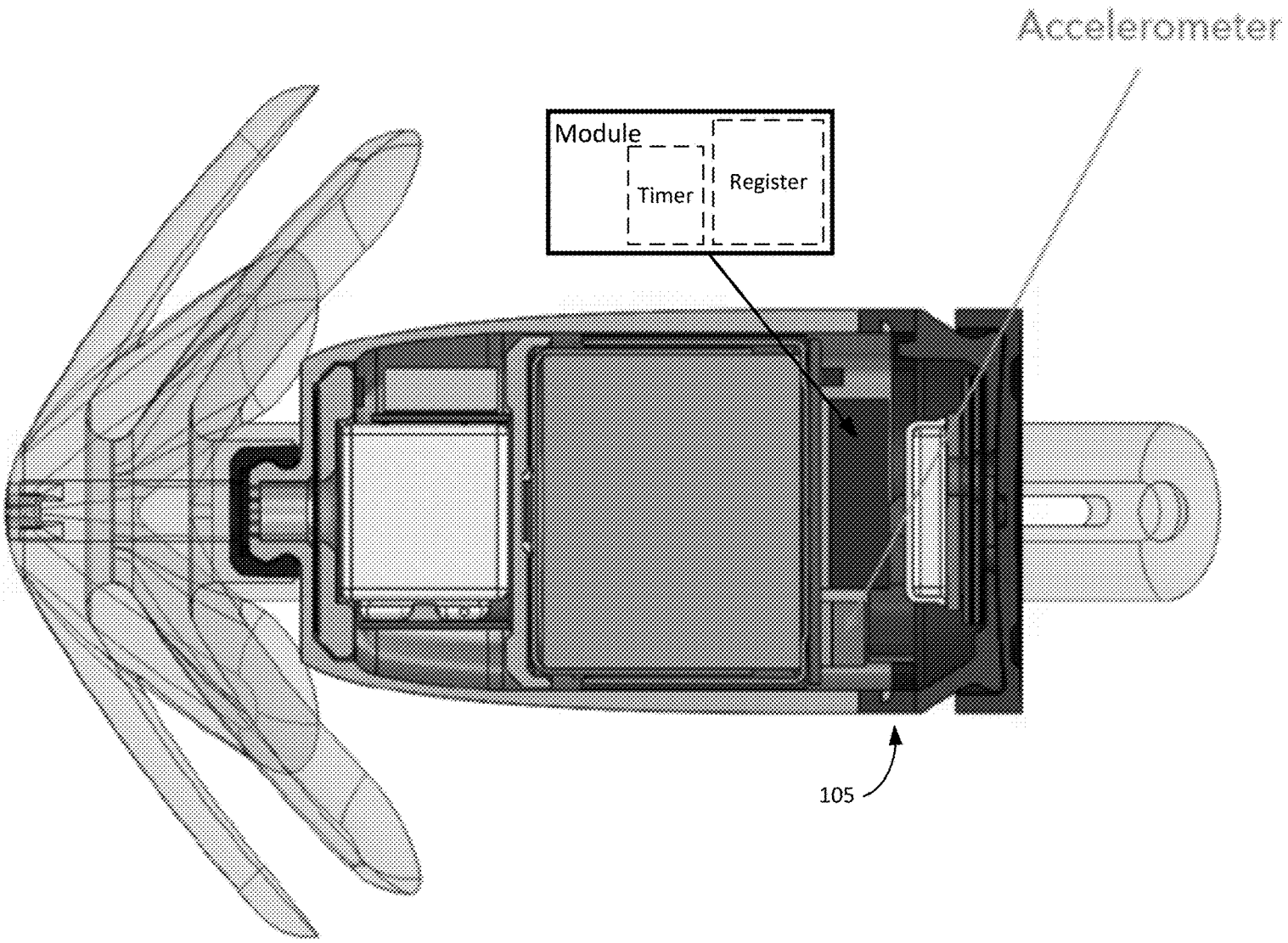
FIG. 3 illustrates an embodiment of a cutaway view of block diagram of an example hearing assistance device showing its accelerometer and power control module with its various components, such as a timer, a register, etc. cooperating with that accelerometer.

The hearing assistance device 105 includes a small accelerometer and signal processor mounted to the circuit board assembly (See FIG. 3). The accelerometer is assembled in a known orientation relative to the hearing assistance device. The accelerometer is mounted inside the hearing assistance device 105 to the PCBA. The PCBA is assembled via adhesives/battery/receiver/dampeners to orient the accelerometer repeatably relative to the enclosure form. The accelerometer measures the dynamic acceleration forces caused by moving as well as the constant force of gravity. The hearing assistance device's outer form may be designed such that it is assembled into the ear canal with a repeatable orientation relative to the head coordinate system (See FIGS. 4-8 below). This will allow the hearing assistance device 105 to know the gravity vector relative to the accelerometer and the head coordinate system and/or lying flat orientation.

In an embodiment, the user moves hearing assistance device 105 (e.g. takes the hearing assistance device 105 out of the charger, picks up the hearing assistance device 105 from table, etc.), powering on the hearing assistance device. The user inserts the pair of hearing assistance devices into their ears. Each hearing assistance device 105 uses the accelerometer to sense the current gravity vector.

FIG. 1 illustrates an embodiment of a block diagram of an example hearing assistance device 105 cooperating with its electrical charger for that hearing assistance device. In the embodiment, the electrical charger may be a carrying case for the hearing assistance devices with various electrical components to charge the hearing assistance devices and also has additional components for other communications and functions with the hearing assistance devices. The power control module can receive a disable signal when the hearing assistant device is in a charging mode. The electrical charger communicating with the hearing assistance device 105 is configured to stop the disable signal when a battery of the hearing assistant device is fully charged.

In an embodiment, a device for use with a hearing assistance device, such as the electrical charger for the hearing assistance device 105 or the hearing assistance device 105 itself can have one or more accelerometers, and a power control module to receive input data indicating a change in acceleration (e.g. jerk) of the device over time from the one or more accelerometers in order to make a determination to autonomously change a power mode, such as turn on, turn off, and low power mode, for the hearing assistance device 105 based on at least whether the power control module senses movement of the hearing assistance device 105 as indicated by the accelerometers.

FIG. 3 illustrates an embodiment of a cutaway view of block diagram of an example hearing assistance device 105 showing its accelerometer and power control module with its various components, such as a timer, a register, etc. cooperating with that accelerometer. The power control module further has a timer, and register to track an operational state of the hearing assistance device. The power control module is configured that after the hearing assistance device 105 is powered on, then the power control module uses the timer to delay a change in the power mode for a set amount of time in order to minimize cycling the hearing assistance device 105 to off and/or in order to eliminate a possible squelching/feedback when inserting the hearing assistance device.

The power control module c detect and ran also detect and register when a user removes the hearing assistance device 105 from the ear and places the hearing assistance device 105 in a stationary position, via a pattern of vectors coming from the accelerometers, then the hearing assistance device 105 goes into a low power sniff mode after a defined time period of remaining still, such as 'X' amount of samples and no change detected.

The power control module can also use a register to track an installed state of the hearing assistance device. The power control module can use the change in acceleration, sensed by the accelerometers, as well as to use a secondary factor of keeping track of a determination of whether the hearing assistance device 105 is currently installed before allowing a change of the power mode of the hearing assistant device to off.

The hearing assistance device 105 may track the insertion state, for example, by detecting no change in an orientation of the hearing aid (i.e. the gravity vector has stayed in a same direction since the power control module initially determined that the hearing assistant device was in fact installed.)

The hearing assistance device 105 may track the insertion state via input from a second type of sensor such as an audio input to a microphone or input data from a gyroscope. The hearing assistance device 105 may combine the vector data from the accelerometers in addition to the input from the sensors to determine insertion state; and thus, keep the power on.

When the user moves the hearing assistance device 105 (takes out of charger, picks up from table, etc.), then the accelerometer in low-power sniff mode senses movement input. The signal processor in sniff mode turns to normal operation with microphone receiver and other processing is activated. Also, when the user removes the hearing assistance device 105 from the ear and places the hearing assistance device 105 in a stationary position, then the hearing assistance device 105 goes into low power sniff mode after a defined time period of remaining still. The accelerometer can detect both the gravity vector and the lack of output from the accelerometer from the lack of movement of the hearing assistance device. Also, when the user stops moving, and remains very still for a threshold amount of time, e.g. sleeping, the hearing assistance device 105 powers off after the defined time period of remaining still. If the user is asleep and still, this also reduces the chance of being woken up by noises. This design conserves power compared to hearing devices without it, since the hearing assistance device 105 has software that cooperates with data inputs from one or more sensors to turn the hearing assistance device 105 off when not in use, or when the user is asleep and still.

The hearing assistance device 105 may use a low-power method to turn on this device via an accelerometer to detect a change in movement. The software cooperating with the sensors of the hearing assistance device 105 will turn off this device to conserve power while the hearing assistance device 105 is not in use, and not in the charging case. The hearing assistance device 105 will also turn off when stationary on a flat reflective surface, which also has the beneficial effect of eliminating annoying feedback noise when left on a table.

The hearing assistance device 105 uses input data from an accelerometer through a software algorithm to determine when the device is being used or not. The hearing assistance device 105 may use one or more sensors to recognize the device's orientation relative to a coordinate system. The hearing assistance device 105 may use at least an accelerometer coupled to a signal processor, such as a DSP, to sense the movement and gravity vectors of the devices current status: in the charging station, lying flat on a surface, or inserted into a head of a user and sensing the orientation of being inserted and movement of the user. The system does know that the +Z axes points into the head on each side, plus or minus the vertical and horizontal tilt of the ear canals, and that gravity is straight down. In transitionary phases between utilization and non-utilization, the hearing assistance device 105 autonomously powers on or powers off, thus conserving power, and reducing the burden upon the user to manually power the unit off and on. Other sensors can also be used to confirm whether the device is inserted in the ear or out of the ear.

FIG. 5 illustrates an embodiment of a block diagram of example hearing assistance devices each with a power control module that may analyze input from multiple different types of sensors to autonomously recognize a current environment that the hearing assistance device 105 is operating in and then be able to alter a threshold of an amount of vectors coming out of the accelerometers to detect the change in acceleration; and thus, change the power mode, while still being able to utilize a less error prone detection algorithm. FIG. 5 also shows a vertical plane view of an example approximate orientation of a hearing assistance device 105 in a head.

These accelerometer input patterns for a person not moving, lying still as well as the gravity pattern for the device lying flat are repeatable. An algorithm can take in the vector variables and orientation coordinates obtained from the accelerometer to determine the current input patterns and compare this to the known vector patterns. The algorithm can use thresholds, if-then conditions, and other techniques to make this comparison to the known vector patterns.

In one example, the system can first determine the gravity vector coming from the accelerometer to an expected gravity vector for a properly inserted and orientated hearing assistance device. The system may normalize the current gravity vector for the current installation and orientation of that hearing assistance device (See FIGS. 9-11 below for possible rotations of the location of the accelerometer and corresponding gravity vector). The hearing assistance devices are installed in both ears at the relatively known orientation.

Several example schemes may be implemented.

Figure 2C:
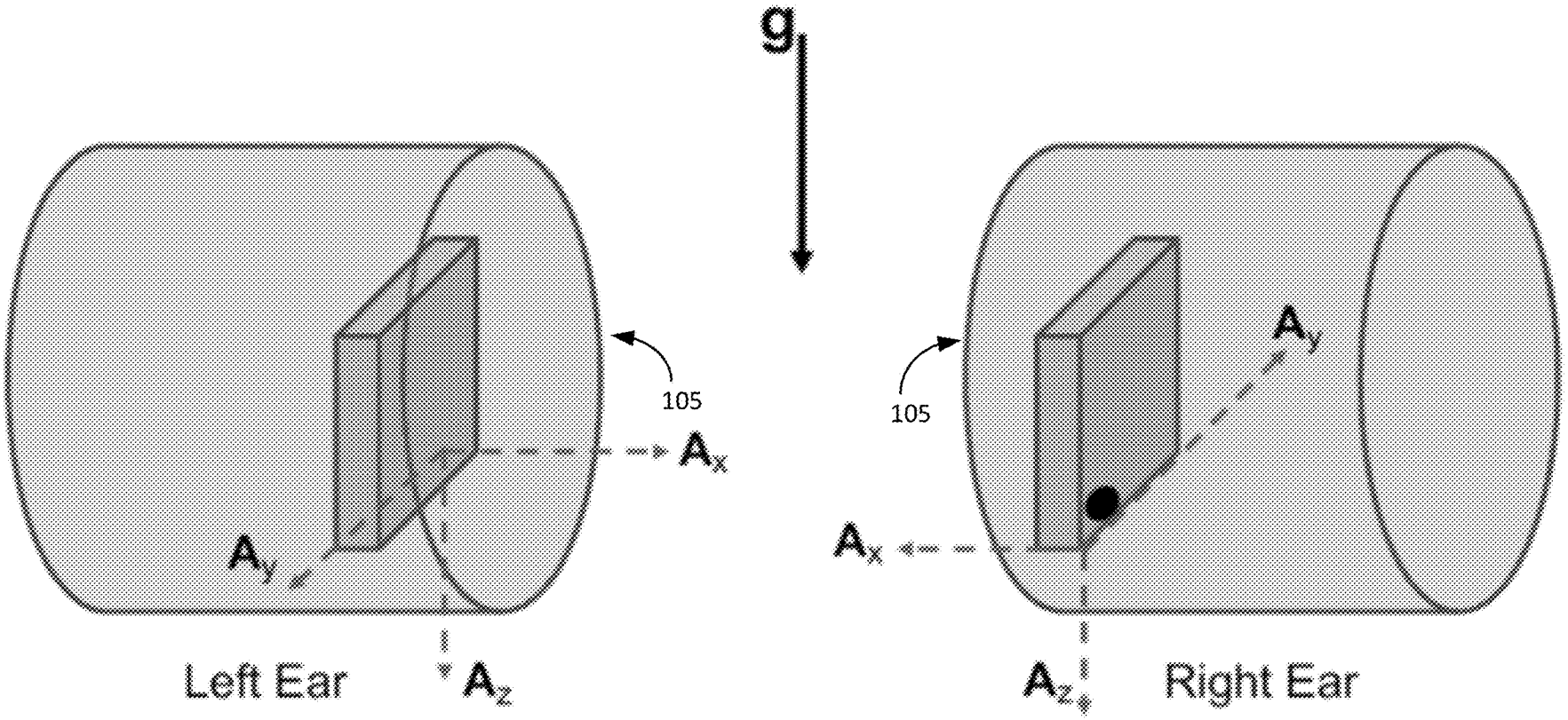
FIG. 2C illustrates an embodiment of a block diagram of an example pair of hearing assistance devices with their accelerometers and their axes relative to the earth frame and the gravity vector on those accelerometers.

FIG. 2C illustrates an embodiment of a block diagram of an example pair of hearing assistance devices with their accelerometers and their axes relative to the earth frame and the gravity vector on those accelerometers. Viewing from the back of the head, the installed two hearing assistance devices have a coordinate system with the accelerometers that is fixed relative to the earth ground because the gravity vector will generally be fairly constant. The coordinate system also shows three different vectors for the left and right accelerometers in the respective hearing assistance devices: Ay, Ax and Az. Az is always parallel to the gravity (g) vector. Axy is always parallel to the ground.

A device for use with a hearing assistance device, such as an electrical charger for the hearing assistance device 105 or the hearing assistance device 105 itself can have one or more accelerometers, and a power control module to receive input data indicating a change in acceleration (e.g. jerk) of the device over time from the one or more accelerometers in order to make a determination to autonomously change a power mode, such as turn on, turn off, and low power mode, for the hearing assistance device 105 based on at least whether the power control module senses movement of the hearing assistance device 105 as indicated by the accelerometers.

A left/right determination module, as part of or merely cooperating with the power module, can use a gravity vector averaged over time into its determination of whether the hearing assistance device 105 is installed in the left or right ear of the user. After several samplings, the average of the gravity vector will remain relatively constant in magnitude and duration compared to each of the other plotted vectors. The time may be for a series of, an example of 3-7 samplings. However, the vectors from noise should vary from each other quite a bit.

In an embodiment, the structure of the hearing assistance device 105 is such that you can guarantee that the grab-post of the device will be pointing down. The hearing assistance device 105 may assume that the grab stick is down, so the accelerometer body frame Ax is roughly anti-parallel with gravity (see FIG. 2B). Accordingly, the acceleration vector in the X-axis is roughly anti-parallel with gravity.

Referring to FIG. 2B showing the accelerometer axes inserted in the body frame for the pair of hearing assistance devices. The view is from behind head with the hearing assistance devices inserted. The "body frame" is the frame of reference of the accelerometer body. Shown here is a presumed mounting orientation. Pin 1's are shown at the origins, with the Y-axes parallel to the ground. In actual use, Az vector will be tilted up or down to fit into ear canals, and the Axy vector may be randomly rotated about Az. These coordinate systems tilt and/or rotate relative to the fixed earth frame.

Thus, the system may record the movement vectors coming from the accelerometer (See also FIGS. 9-12I below). The accelerometer senses the movement vectors and the gravity vector. The system via the signal processor may then compare these recorded vector patterns to known vector patterns. These accelerometer input patterns for moving are repeatable. An algorithm can take in the vector variables and orientation coordinates obtained from the accelerometer to determine the current input patterns and compare this to the known vector patterns to determine whether the hearing assistance device 105 is inserted in an ear or lying flat on a surface. The algorithm can use thresholds, if-then conditions, and other techniques to make this comparison to the known vector patterns. Overall, the accelerometer senses movement and gravity vectors. Next, the DSP takes a few seconds to process the signal, and determine whether to autonomously turn power on/power off for the device.

In an embodiment, the user moves hearing assistance device 105 (e.g. takes the hearing assistance device 105 out of the charger, picks up the hearing assistance device 105 from table, etc.), powering on the hearing assistance device. Each hearing assistance device 105 uses the accelerometer to sense the current gravity vector.

Ultimately, the user does not have to think about turning the hearing assistance device 105 on and off.

The accelerometer is mounted to PCBA. The PCBA is assembled via adhesives/battery/receiver/dampeners to orient accelerometer repeatably relative to the enclosure form.

FIGS. 7A-7C illustrate an embodiment of a block diagram of an example hearing assistance device 105 with three different views of the hearing assistance device 105 installed. The top left view FIG. 7A is a top-down view showing arrows with the vectors from movement, such as walking forwards or backwards, coming from the accelerometers in those hearing assistance devices 105. FIG. 7A also shows circles for the vectors from gravity coming from the accelerometers in those hearing assistance devices 105. The bottom left view FIG. 7B shows the vertical plane view of the user's head with circles showing the vectors for movement as well as downward arrows showing the gravity vector coming from the accelerometers in those hearing assistance devices 105. The bottom right view FIG. 7C shows the side view of the user's head with a horizontal arrow representing a movement vector and a downward arrow reflecting a gravity vector coming from the accelerometers in those hearing assistance devices 105.

FIGS. 7A-7C thus show multiple views of an example approximate orientation of a hearing assistance device 105 in a head. The GREEN arrow indicates the gravity vector when the hearing assistance device 105 is inserted in the ear canal. The RED arrow indicates the walking forwards & backwards vector when the hearing assistance device 105 is inserted in the ear canal.

FIG. 8 shows a view of an example approximate orientation of a hearing assistance device 105 in a head with its removal thread beneath the location of the accelerometer and extending downward on the head. The GREEN arrow indicates the gravity vector when the hearing assistance device 105 is inserted in the ear canal. The GREEN arrow indicates the gravity vector that generally goes in a downward direction. The RED circle indicates the walking forwards & backwards vector when the hearing assistance device 105 is inserted in the ear canal. The yellow, black, and blue arrows indicate the X, Y, and Z coordinates when the hearing assistance device 105 is inserted in the ear canal. The Z coordinate is the blue arrow. The Z coordinate is the blue arrow that goes relatively horizontal. The X coordinate is the black arrow. The Y coordinate is the yellow arrow. The yellow and black arrows are locked at 90 degrees to each other.

FIG. 8 shows a view of an example approximate orientation of a hearing assistance device 105 in a head with its removal thread beneath the location of the accelerometer and extending downward on the head.

FIG. 9 shows figure shows an isometric view of the hearing assistance device 105 inserted in the ear canal. Each image of the hearing assistance device 105 with the accelerometer is shown with a 90-degree rotation of the hearing assistance device 105 from the previous image. The GREEN arrow indicates the gravity vector when the hearing assistance device 105 is inserted in the ear canal. The GREEN arrow indicates the gravity vector that generally goes in a downward direction. The RED circle indicates the walking forwards & backwards vector when the hearing assistance device 105 is inserted in the ear canal. The yellow, black, and blue arrows indicate the X, Y, and Z coordinates when the hearing assistance device 105 is inserted in the ear canal. The Z coordinate is the blue arrow that goes relatively horizontal. The X coordinate is the black arrow. The Y coordinate is the yellow arrow. The yellow and black arrows are locked at 90 degree to each other.

FIG. 10 shows a side view of the hearing assistance device 105 inserted in the ear canal. Each image of the hearing assistance device 105 with the accelerometer is shown with a 90-degree rotation of the hearing assistance device 105 from the previous image. The GREEN arrow indicates the gravity vector when the hearing assistance device 105 is inserted in the ear canal. The GREEN arrow indicates the gravity vector that generally goes in a downward direction. The RED arrow indicates the walking forwards & backwards vector when the hearing assistance device 105 is inserted in the ear canal. The RED arrow indicates the walking forwards & backwards vector that generally goes in a downward and to the left direction. The yellow, black, and blue arrows indicate the X, Y, and Z coordinates when the hearing assistance device 105 is inserted in the ear canal. The Z coordinate is the blue arrow that goes relatively horizontal.

FIG. 11 shows a back view of the hearing assistance device 105 inserted in the ear canal. Each image of the hearing assistance device 105 with the accelerometer is shown with a 90-degree rotation of the hearing assistance device 105 from the previous image. The GREEN arrow indicates the gravity vector when the hearing assistance device 105 is inserted in the ear canal. The GREEN arrow indicates the gravity vector that generally goes in a downward direction. The RED arrow indicates the walking forwards & backwards vector when the hearing assistance device 105 is inserted in the ear canal. The RED arrow indicates the walking forwards & backwards vector that generally goes in a downward and to the left direction. The yellow, black, and blue arrows indicate the X, Y, and Z coordinates when the hearing assistance device 105 is inserted in the ear canal. The Z coordinate is the blue circle. The yellow and black arrows are locked at 90 degree to each other.

The algorithm can take in the vector variables and orientation coordinates obtained from the accelerometer to determine the current input patterns and compare this to the known vector patterns for the right ear and known vector patterns for the left ear to determine, which ear the hearing assistance device 105 is inserted in.

FIG. 13 illustrates an embodiment of a block diagram of an example hearing assistance device 105 that includes an accelerometer, a microphone, a power control module with a signal processor, a battery, a capacitive pad, and other components. The power control module can use the change in acceleration sensed by the accelerometers as well as to use input data from one or more additional sensors. The additional sensors may include but are not limited to the hearing assistance device 105 which has one or more additional sensors including but not limited to a microphone and a gyroscope. The power control module can use the change in acceleration sensed by the accelerometers as well as to use input from the additional sensors such as an audio input to the microphone or input data from the gyroscope to determine whether the hearing assistance device 105 is installed; and therefore, should be powered on.

The hearing assistance device 105 may use a sensor combination of an accelerometer, a microphone, a signal processor, and a capacitive pad to turn the device off and on. The accelerometer, the microphone, and the capacitive pad may mount to a flexible PCBA circuit, along with a digital signal processor configured for converting input signals into program changes (See FIG. 13). All of these sensors are assembled in a known orientation relative to the hearing assistance device. The hearing assistance device's outer form is designed such that it is assembled into the ear canal with a repeatable orientation relative to the head coordinate system, and the microphone and capacitive pad face out of the ear canal. The accelerometer is tightly packed into the shell of the device to better detect subtle movements of the user when inserted in the user's head. The shell may be made of a rigid material having a sufficient stiffness to be able to transmit the vibrations to the accelerometer.

FIG. 14 illustrates an embodiment of an exploded view of an example hearing assistance device 105 that includes an accelerometer, a microphone, a power control module, a clip tip with the snap attachment and overmold, a clip tip mesh, petals/fingers of the clip tip, a shell, a shell overmold, a receiver filter, a dampener spout, a PSA spout, a receiver, a PSA frame receive side, a dampener frame, a PSA frame battery slide, a battery, isolation tape around the compartment holding the accelerometer, other sensors, modules, etc., a flex, a microphone filter, a cap, a microphone cover, and other components.

The power control module is configured to analyze input from multiple different types of sensors to autonomously recognize a current environment that the hearing assistance device 105 is operating in and then be able to alter a threshold of an amount of vectors coming out of the accelerometers to detect the change in acceleration; and thus, change the power mode, while still being able to utilize a less error prone detection algorithm.

In an embodiment, an open ear canal hearing assistance device 105 may include: an electronics containing portion to assist in amplifying sound for an ear of a user; and a securing mechanism that has a flexible compressible mechanism connected to the electronics containing portion. The flexible compressible mechanism is permeable to both airflow and sound to maintain an open ear canal throughout the securing mechanism. The securing mechanism is configured to secure the hearing assistance device 105 within the ear canal, where the securing mechanism consists of a group of components selected from i) a plurality of flexible fibers, ii) one or more balloons, and iii) any combination of the two, where the flexible compressible mechanism covers at least a portion of the electronics containing portion. The flexible fiber assembly is configured to be compressible and adjustable in order to secure the hearing aid within an ear canal. A passive amplifier may connect to the electronics-containing portion. The flexible fiber assembly may contact an ear canal surface when the hearing aid is in use, and providing at least one airflow path through the hearing aid or between the hearing aid and ear canal surface. The flexible fibers are made from a medical grade silicone, which is a very soft material as compared to hardened vulcanized silicon rubber. The flexible fibers may be made from a compliant and flexible material selected from a group consisting of i) silicone, ii) rubber, iii) resin, iii) elastomer, iv) latex, v) polyurethane, vi) polyamide, vii) polyimide, viii) silicone rubber, ix) nylon and x) combinations of these, but not a material that is further hardened including vulcanized rubber. Note, the plurality of fibers being made from the compliant and flexible material allows for a more comfortable extended wearing of the hearing assistance device 105 in the ear of the user.

The flexible fibers are compressible, for example, between two or more positions. The flexible fibers act as an adjustable securing mechanism to the inner ear. The plurality of flexible fibers are compressible to a collapsed position in which an angle that the flexible fibers, in the collapsed position, extend outwardly from the hearing assistance device 105 to the surface of the ear canal is smaller than when the plurality of fibers are expanded into an open position. Note, the angle of the fibers is measured relative to the electronics-containing portion. The flexible fiber assembly is compressible to a collapsed position expandable to an adjustable open position, where the securing mechanism is expandable to the adjustable open position at multiple different angles relative to the ear canal in order to contact a surface of the ear canal so that one manufactured instance of the hearing assistance device 105 can be actuated into the adjustable open position to conform to a broad range of ear canal shapes and sizes.

The flexible fiber assembly may contact an ear canal surface when the hearing aid is in use, and providing at least one airflow path through the hearing aid or between the hearing aid and ear canal surface. In an embodiment, the hearing assistance device 105 may be a hearing aid, or simply an ear bud in-ear speaker, or other similar device that boosts a human hearing range frequencies. The body of the hearing aid may fit completely in the user's ear canal, safely tucked away with merely a removal thread coming out of the ear.

FIG. 6 illustrates an embodiment of a block diagram of an example hearing assistance device, such as a hearing aid or an ear bud. The hearing assistance device 105 can take a form of a hearing aid, an ear bud, earphones, headphones, a speaker in a helmet, a speaker in glasses, etc. The smart phone and/or smart watch can analyze data to communicate with the power control module. FIG. 6 also shows a side view of an example approximate orientation of a hearing assistance device 105 in the head. The form of the hearing assistance device 105 can be implemented in a device such as a hearing aid, a speaker in a helmet, a speaker in a glasses, ear phones, head phones, or ear buds.

Referring back to FIG. 14, because the flexible fiber assembly suspends the hearing aid device in the ear canal and doesn't plug up the ear canal, natural, ambient low (bass) frequencies pass freely to the user's eardrum, leaving the electronics-containing portion to concentrate on amplifying mid and high (treble) frequencies. This combination gives the user's ears a nice mix of ambient and amplified sounds reaching the eardrum.

The hearing assistance device 105 further has an amplifier. The flexible fibers assembly is constructed with the permeable attribute to pass both air flow and sound through the fibers which allows the ear drum of the user to hear lower frequency sounds naturally without amplification by the amplifier while amplifying high frequency sounds with the amplifier to correct a user's hearing loss in that high frequency range. The set of sounds containing the lower frequency sounds is lower in frequency than a second set of sounds containing the high frequency sounds that are amplified.

The flexible fibers assembly lets air flow in and out of your ear, making the hearing assistance device 105 incredibly comfortable and breathable. And because each individual flexible fiber in the bristle assembly exerts a miniscule amount of pressure on your ear canal, the hearing assistance device 105 will feel like its merely floating in your ear while staying firmly in place.

The hearing assistance device 105 has multiple sound settings. They're highly personal and have four different sound profiles. These settings are designed to work for the majority of people with mild to moderate hearing loss.

The hearing assistance device 105 has a battery to power at least the electronics-containing portion. The battery is rechargeable, because replacing tiny batteries is a pain. The hearing assistance device 105 has rechargeable batteries with enough capacity to last all day. The hearing assistance device 105 has the permeable attribute to pass both air flow and sound through the fibers, which allows sound transmission of sounds external to the ear in a first set of frequencies to be heard naturally without amplification by the amplifier while the amplifier is configured to amplify only a select set of sounds higher in frequency than contained the first set. Merely needing to amplify a select set of frequencies in the audio range verses every frequency in the audio range makes more energy-efficient use of the hearing assistance device 105 that results in an increased battery life for the battery before needing to be recharged, and avoids over-amplification by the amplifier in the first set of frequencies that results in better hearing in both sets of frequencies for the user of the hearing assistance device.

Because the hearing aids fits inside the user's ear and right beside your eardrum, they amplify sound within your range of sight (as nature intended) and not behind you, like behind-the-ear devices that have microphones amplifying sound from the back of your ear. That way, the user's can track who's actually talking to the user and not get distracted by ambient noise.

Figure 12A:
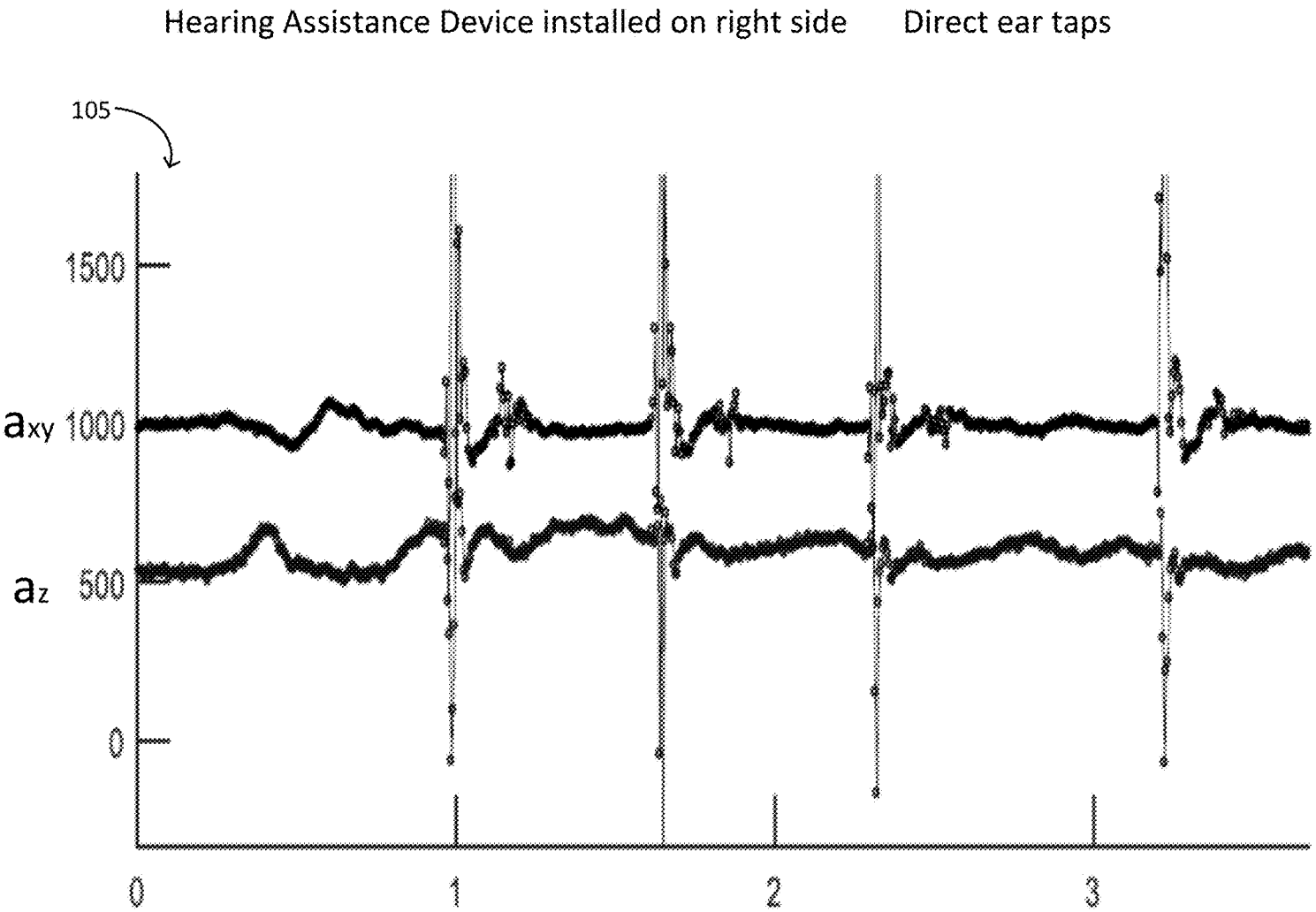

FIG. 12A illustrates an embodiment of a graph of vectors as sensed by one or more accelerometers mounted in example hearing assistance device 105. The graph may vertically plot the magnitude, such an example scale 0 to 1500, and horizontally plot time, such as 0-3 units of time. In this example, the hearing assistance device 105 is installed in a right ear of the user and that user is taking a set of user actions of tapping on the right ear, which has the hearing assistance device 105 installed in that ear. Shown for the top response plotted on the graph is the Axy vector. The graph below the top graph is the response for the Az vector. With the device in the right ear, tapping on the right should induce a positive Az bump on the order of a few hundred milliseconds. However in this instance, the plotted graph shows a negative high-frequency spot spike with a width on the order of around 10 milliseconds. In both cases, they both have significant changes in magnitude due to the tap being on the corresponding side where the hearing assistance device 105 is installed. In this case of the negative spike from the tap, it is thought that the tap also slowly stores elastic energy in the flexible fingers/petals, which is then released quickly in a rebound that is showing up on the plotted vectors. The user actions of the taps may be performed as a sequence of taps with an amount of taps and a specific cadence to that sequence.

The user interface, the one or more accelerometers, and the left/right determination module, and power control module can cooperate to determine whether the hearing assistance device 105 is inserted and/or installed on a left side or right side of a user via an analysis of a current set of vectors of orientation sensed by the accelerometers when the user taps a known side of their head and any combination of a resulting i) magnitude of the vectors, ii) an amount of taps and a corresponding amount of spikes in the vectors, and iii) a frequency cadence of a series of taps and how the vectors correspond to a timing of the cadence (See FIGS. 12A-12I).

See FIGS. 12A-12I also for examples of known signal responses to different environmental situations and the sensor's response data.

The user interface, the one or more accelerometers, and the power control module can cooperate to determine whether the hearing assistance device 105 is inserted and/or should be powered on via an analysis of a current set of vectors of orientation sensed by the accelerometers when the user takes actions and any combination of a resulting i) magnitude of the vectors, ii) an amount of taps and a corresponding amount of spikes in the vectors, and iii) a frequency cadence of a series of taps and how the vectors correspond to a timing of the cadence (See FIGS. 12A-12I). Also, the power control module can compare magnitudes and amount of taps to a statistically set magnitude threshold to test if the magnitude tap is equal to or above that set fixed threshold to qualify to change a power mode. The power control module is configured to factor in a gravity vector from the one or more accelerometers into its determination of both i) whether the hearing assistance device 105 is moving, as indicated by the change of acceleration of the hearing assistance device, and ii) whether the hearing assistance device 105 is installed in an ear of the user as indicated at least by an evaluation of the gravity vector coming out of the accelerometers.

Also, the power control module can compare magnitudes and amount of taps for left or right to a statistically set magnitude threshold to test if the magnitude tap is equal to or above that set fixed threshold to qualify as a secondary factor to verify which ear the hearing aid is in.

Figure 12B:
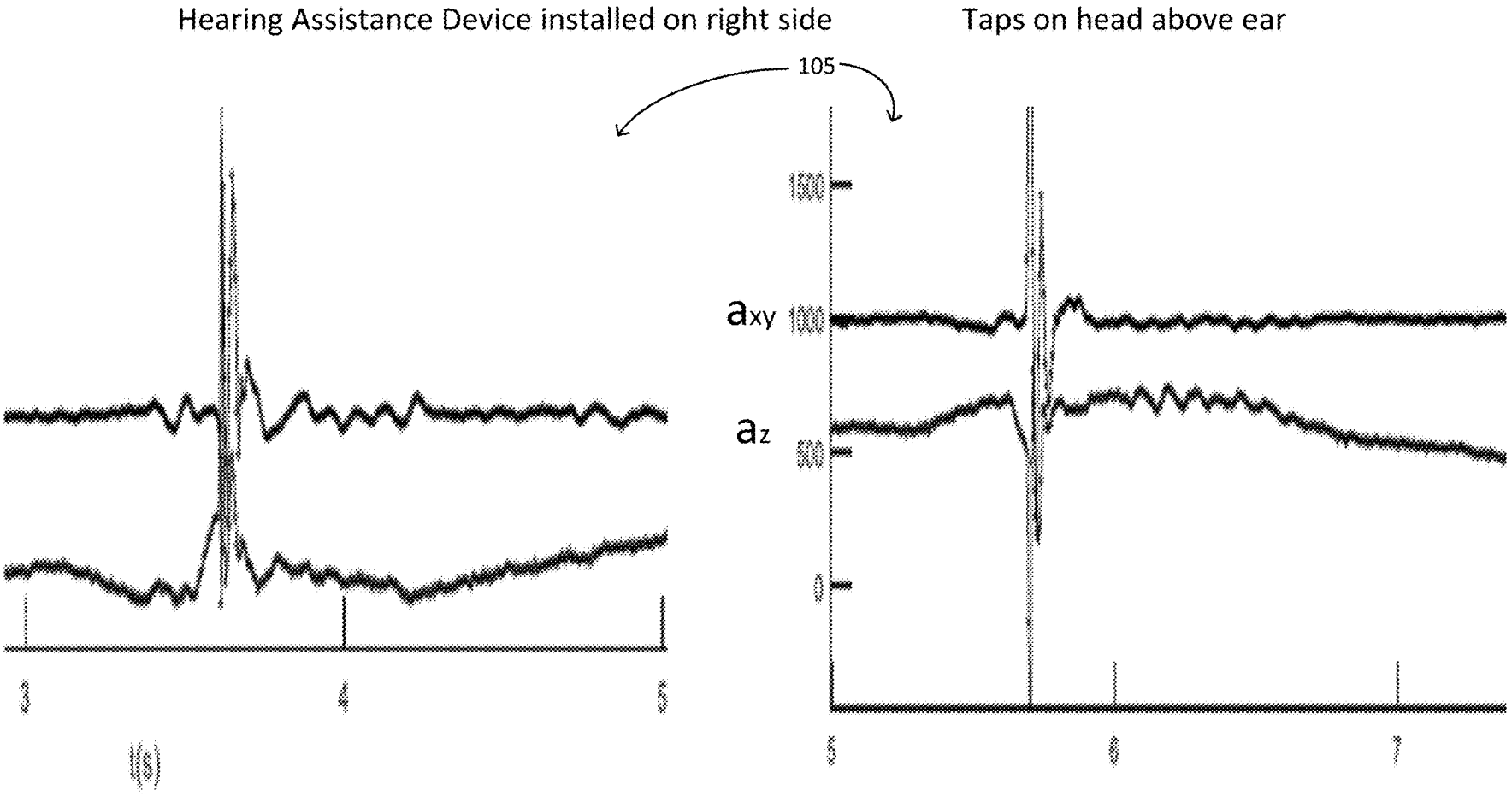

FIG. 12B illustrates an embodiment of a graph of vectors of an example hearing assistance device 105. The graph may vertically plot the magnitude, such an example scale 0 to 1500, and horizontally plot time, such as 3-5 and 5-7 units of time. In this example, the hearing assistance device 105 is installed in a right ear of the user and that user is taking a set of user actions of tapping very hard on their head above the ear, initially on left side and then on the right side. The graphs show the vectors for Az and Axy from the accelerometer. The graph on the left with the hearing assistance device 105 installed in the right ear has the taps occurring on the left side of the head. The taps on the left side of the head cause a low-frequency acceleration to the right file via rebound. This causes a broad dip and recovery from three seconds to five seconds. There is a hump and a sharp peek at around 3.6 seconds in which the device is moving to the left. The graph on the right shows a tap on the right side of the head with the hearing assistance device 105 installed in the right ear. Tapping on the right side of the head causes a low frequency acceleration to the left followed by a rebound; as opposed to, an acceleration to the right resulting from a left side tap. This causes a broad pump recovery from 5 to 7 seconds there is a dip and a sharp peek at around 5.7 seconds which is the device moving to the right.

Figure 12C:
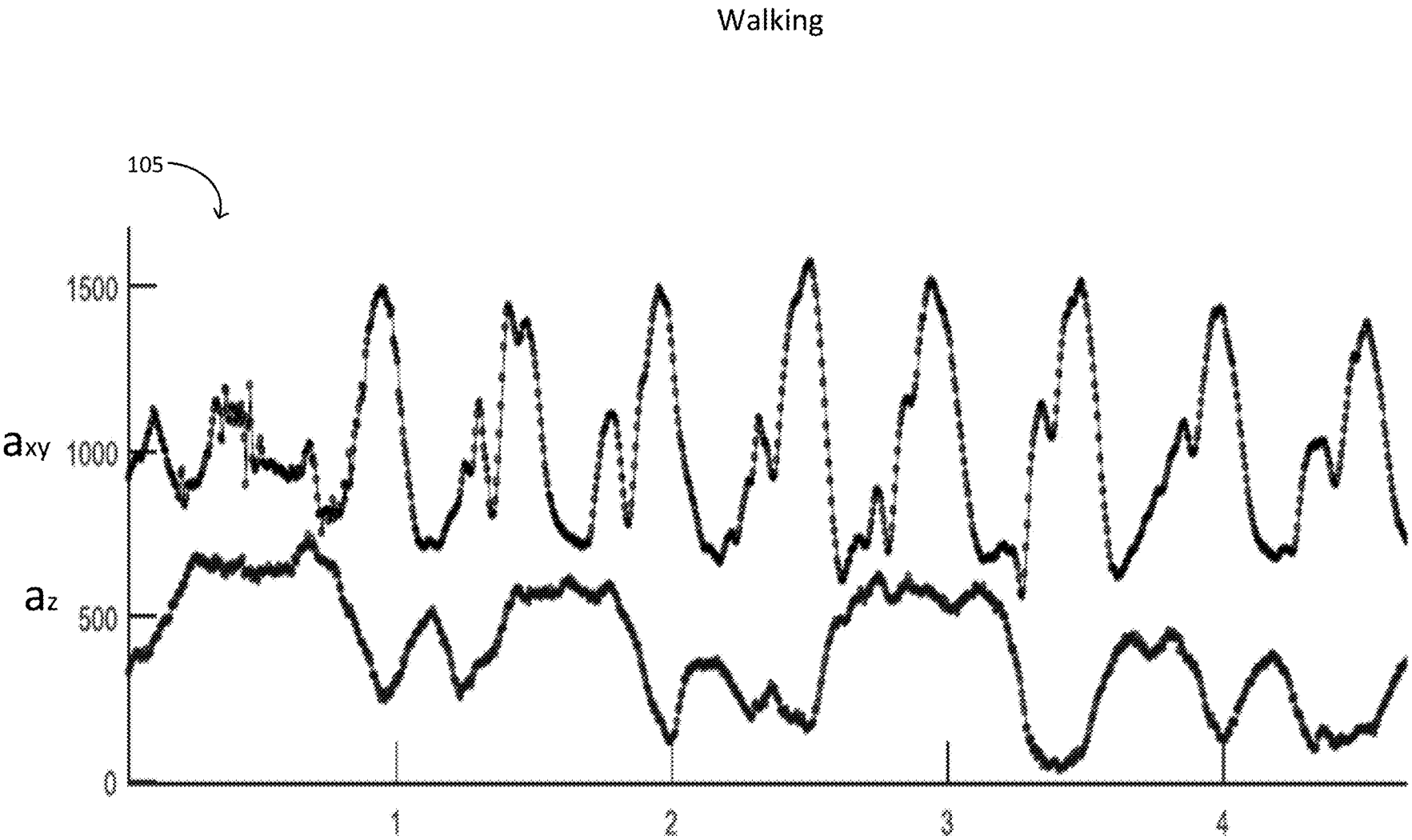

FIG. 12C illustrates an embodiment of a graph of vectors of an example hearing assistance device 105. The graph may vertically plot the magnitude, such an example scale 0 to 1500, and horizontally plot time, such as 0-5 units of time. The graph shows the vectors for Az and Axy from the accelerometer. In this example, the hearing assistance device 105 is installed in a right ear of the user and that user is taking a set of user actions of simply walking in place. The vectors coming from the accelerometer contain a large amount of low-frequency components. The plotted jiggles below 1 second are from the beginning to hold the wire still against the head. By estimation, the highest frequency components from walking in place maybe around 10 Hz. The graphs so far, 12A-12C, show that different user activities can have very distinctive characteristics from each other.

Figure 12D:
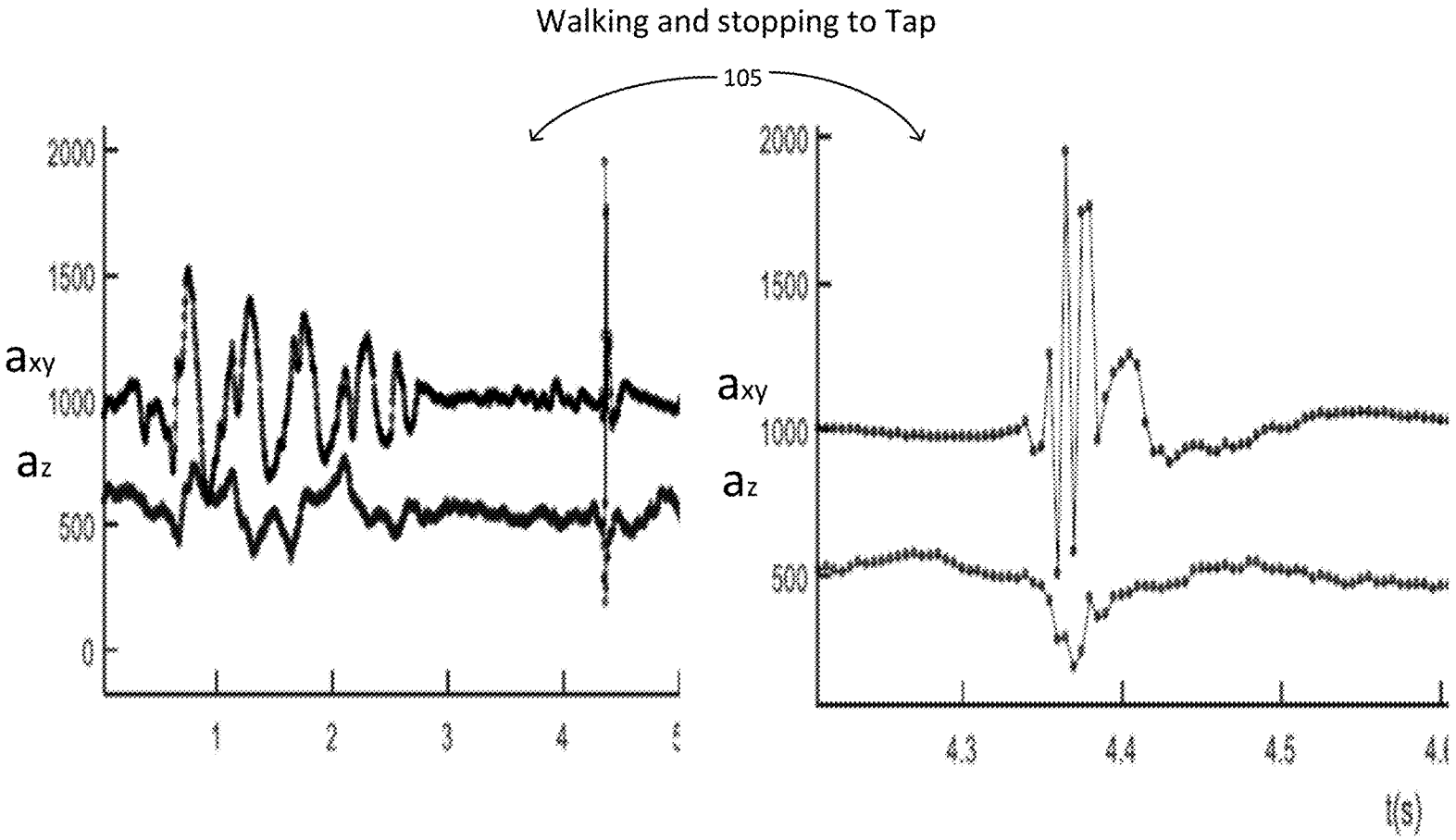

FIG. 12D illustrates an embodiment of a graph of vectors of an example hearing assistance device 105. The graph may vertically plot the magnitude, such an example scale 0 to 2000, and horizontally plot time, such as 0-5 units of time. The graph shows the vectors for Az and Axy from the accelerometer. In this example, the hearing assistance device 105 is installed in a right ear of the user and that user is taking a set of user actions of walking in a known direction and then stopping to tap on the right ear. The graph on the left shows that the tapping on the ear has a positive low-frequency bump, as expected, just before 4.3 seconds. However, this bump is not particularly distinct from other low-frequency signals by itself. However, in combination at about 4.37 seconds we see the very distinct high-frequency rebound that has a large magnitude. The graph on the right is an expanded view from 4.2 to 4.6 seconds.

The user actions causing control signals as sensed by the accelerometers can be a sequence of one or more taps to initiate the determination of which ear the hearing assistance device 105 is inserted in and then the user interface prompts the user to do another set of user actions such as move their head in a known direction so the vectors coming out of the one or more accelerometers can be checked against an expected set of vectors when the hearing assistance device 105 is moved in that known direction.

Figure 12E:
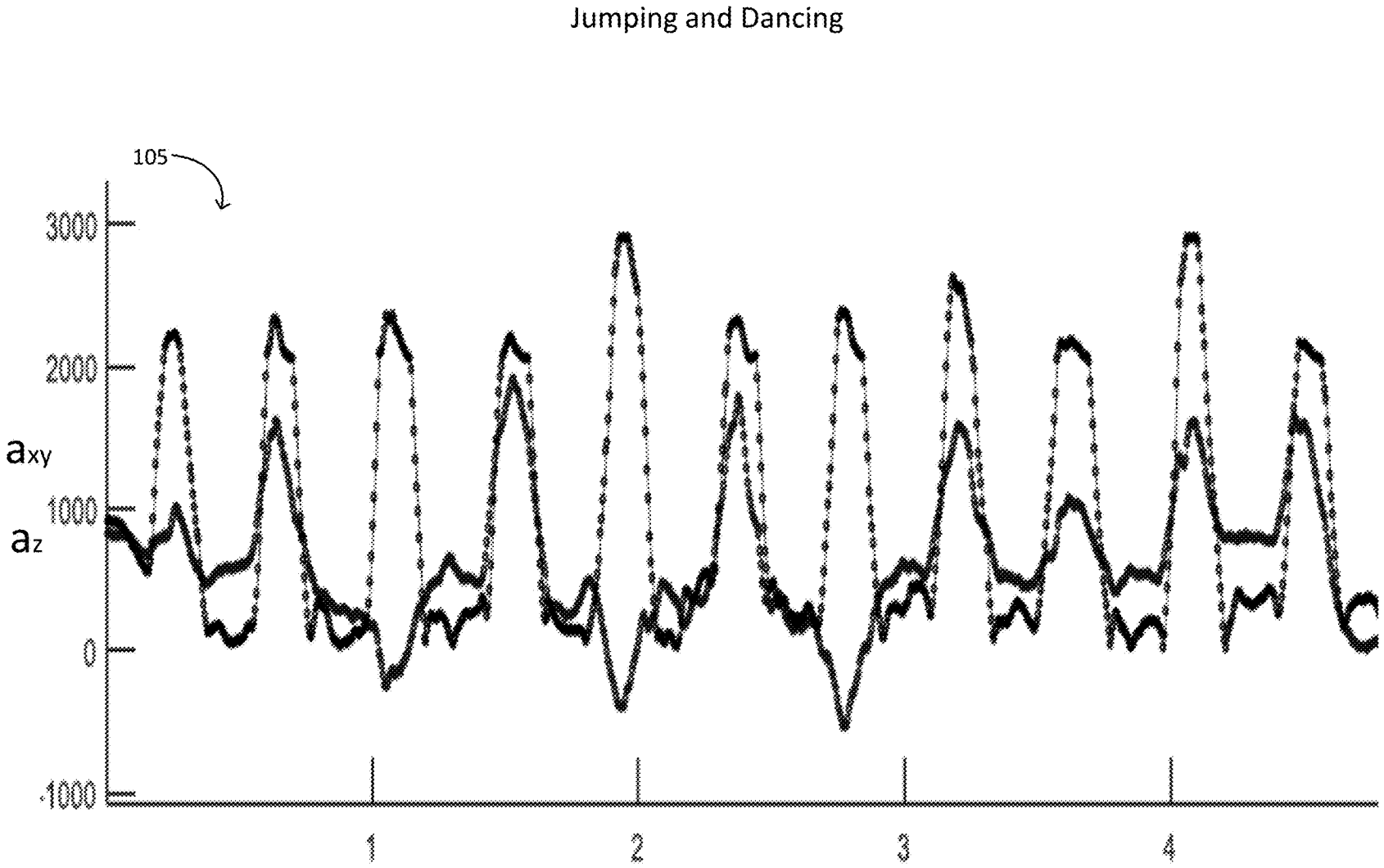

FIG. 12E illustrates an embodiment of a graph of vectors of an example hearing assistance device 105. The graph may vertically plot the magnitude, such an example scale 0 to 3000, and horizontally plot time, such as 0-5 units of time. The graph shows the vectors for Az and Axy from the accelerometer. In this example, the hearing assistance device 105 is installed in a right ear of the user and that user is taking a set of user actions of jumping and dancing. What can be discerned from the plotted graphs is user activities, such as walking, jumping, dancing, may have some typical characteristics. However, these routine activities definitely do not result in the high-frequency spikes with their rebound oscillations seen when a tap on the head occurs.

Figure 12F:
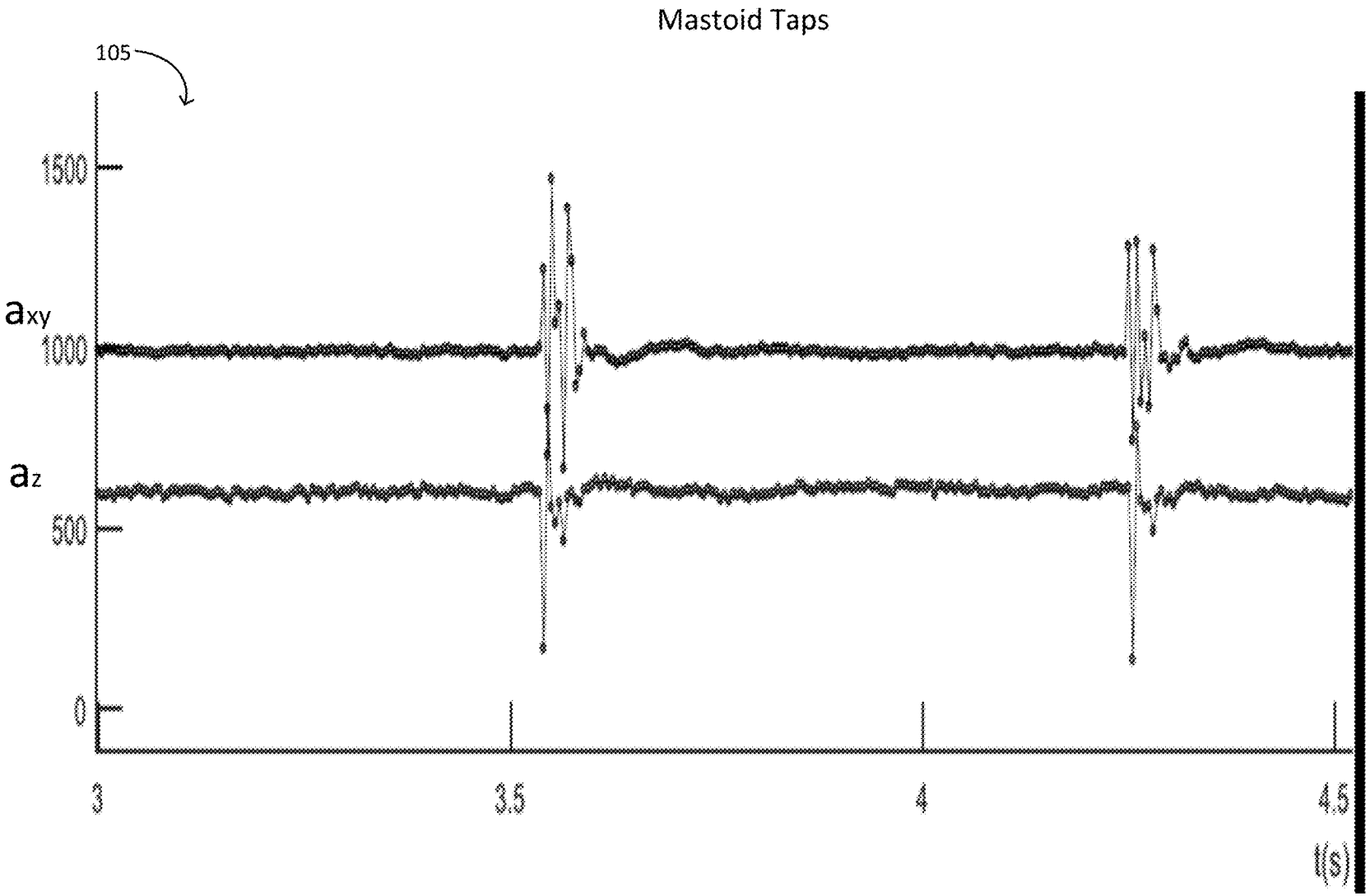

FIG. 12F illustrates an embodiment of a graph of vectors of an example hearing assistance device 105. The graph may vertically plot the magnitude, such an example scale 0 to 1500, and horizontally plot time, such as 0-5 units of time. The graph shows the vectors for Az and Axy from the accelerometer. In this example, the hearing assistance device 105 is installed in a right ear of the user and that user is taking a set of user actions of tapping on their mastoid part of the temporal bone. The graph shows, just like taps directly on the ear, taps on the mastoid bone on the same side as the installed hearing assistance device 105 should go slightly positive. However, we do not see that here perhaps because the effect is smaller tapping on the mastoid or the flexi-fingers/petals of the hearing assistance device 105 act as a shock absorber. Nonetheless, we do see a sharp spike that is initially highly negative in magnitude. Contrast this with the contralateral taps shown in the graph of FIG. 12G, which initially go highly positive with the spike. Nevertheless, generalizing this information to all taps, whether they be directly on the ear or on other portions of the user's head, the initial spike pattern of a tap might act as a telltale sign of vectors coming out of the accelerometer due to a tap. Thus, a user action such as a tap can help in identifying which side a hearing assistance device 105 in installed on as well as being a discernable action to control an audio configuration of the device.

Figure 12G:
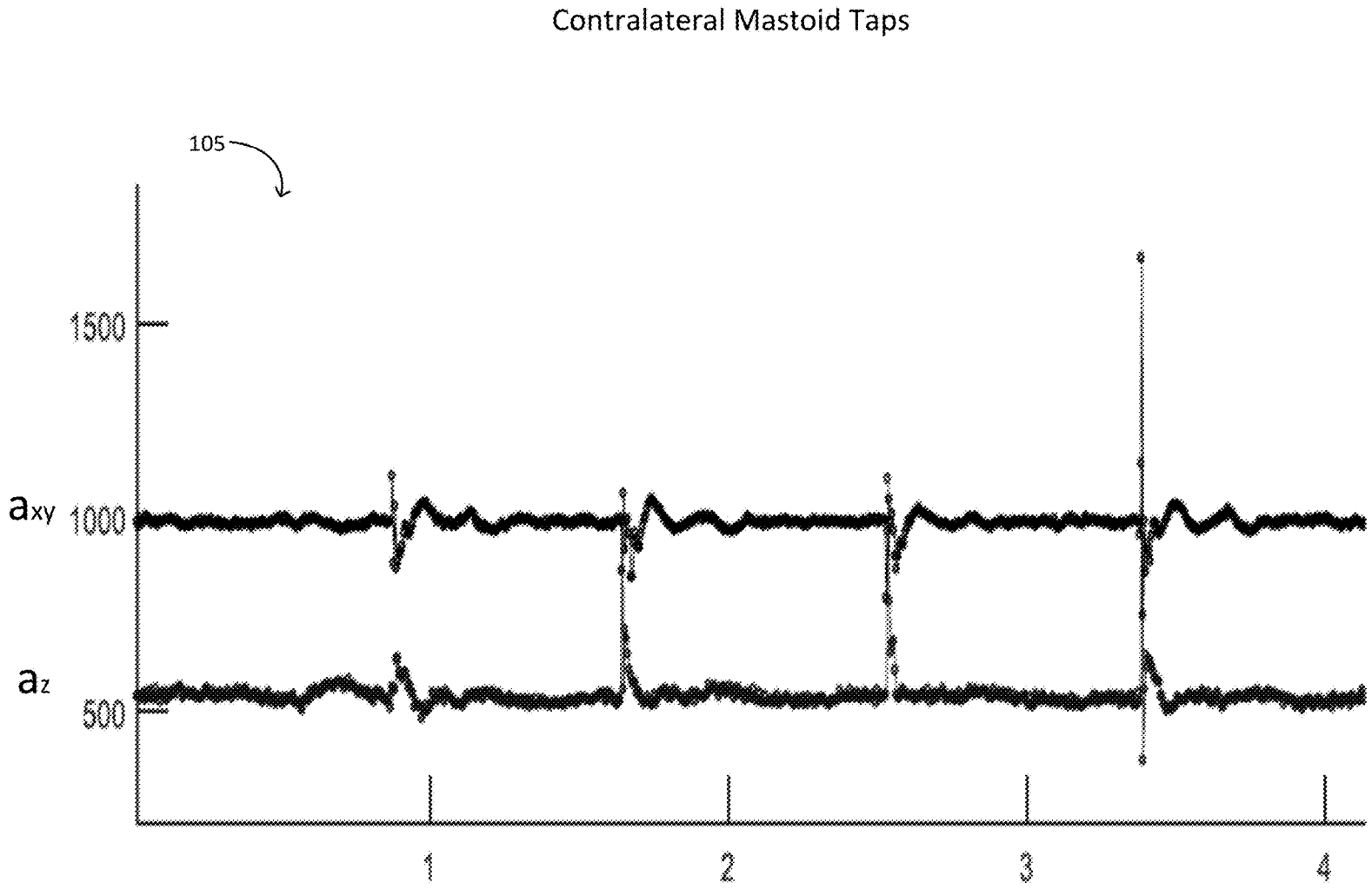

FIG. 12G illustrates an embodiment of a graph of vectors of an example hearing assistance device 105. The graph may vertically plot the magnitude, such an example scale 0 to 1500, and horizontally plot time, such as 0-4 units of time. The graph shows the vectors for Az and Axy from the accelerometer. In this example, the hearing assistance device 105 is installed in a right ear of the user and that user is taking a set of user actions of contralateral taps on the mastoid. The taps occur on the opposite side of where the hearing assistance device 105 is installed. Taps on the left mastoid again show a sharp spike that is initially highly positive. Thus, by looking at initial sign of the sharp peak and its characteristics, we can tell if the taps were on the same side of the head as the installed hearing assistance device 105 or on the opposite side.

Figure 12H:
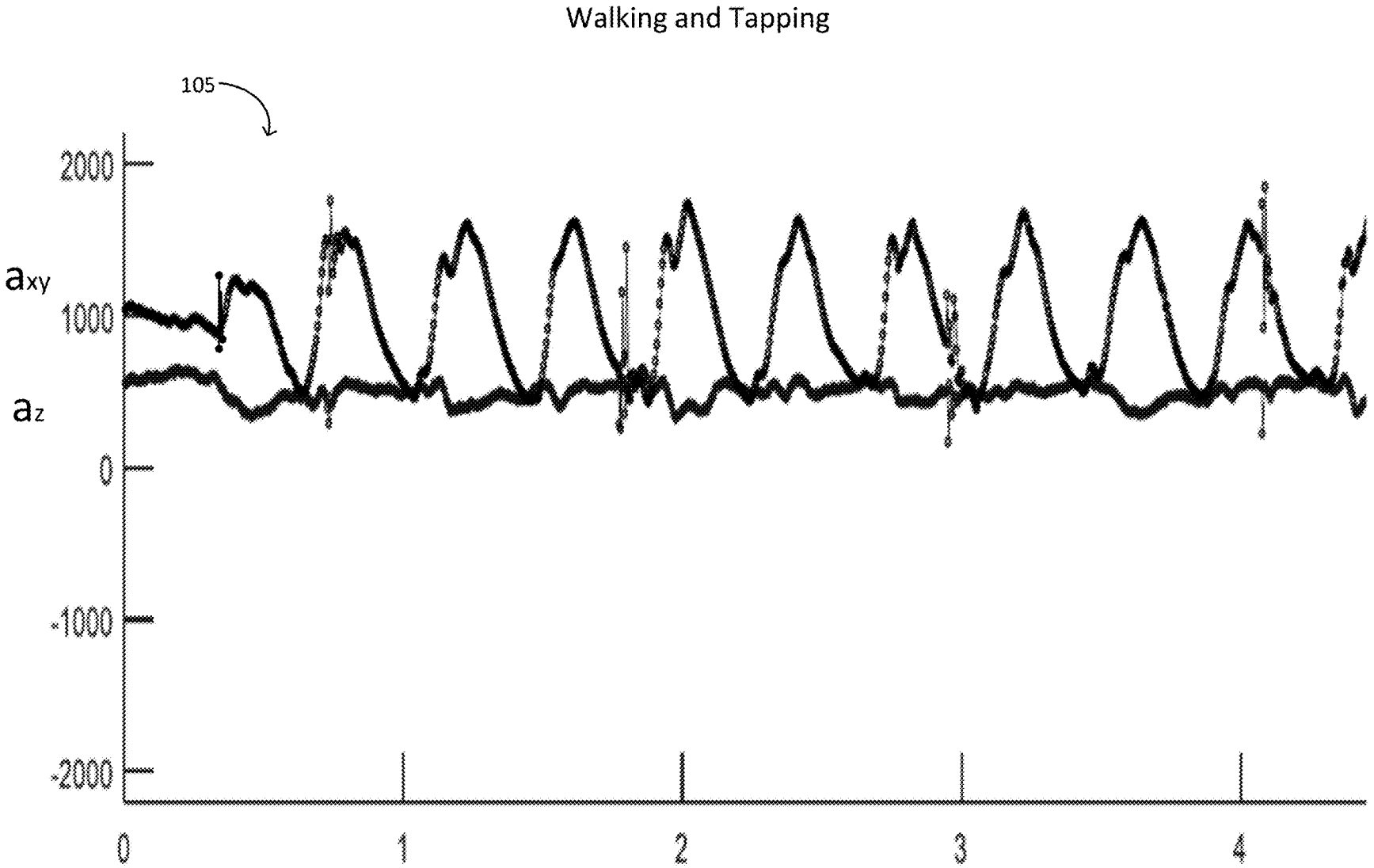

FIG. 12H illustrates an embodiment of a graph of vectors of example hearing assistance device 105. The graph may vertically plot the magnitude, such an example scale minus 2000 to positive 2000, and horizontally plot time, such as 0-5 units of time. The graph shows the vectors for Az and Axy from the accelerometer. In this example, the hearing assistance device 105 is installed in a right ear of the user and that user is taking a set of user actions of walking while sometimes also tapping. The high-frequency elements (e.g. spikes) from the taps are still highly visible even in the presence of the other vectors coming from walking. Additionally, the vectors from the tapping can be isolated and analyzed by applying a noise filter, such as a high pass filter or a two-stage noise filter.

The left/right determination module and the power control module can be configured to use a noise filter to filter out noise from a gravity vector coming out of the accelerometers. The noise filter may use a low pass moving average filter with periodic sampling to look for a relatively consistent vector coming out of the accelerometers due to gravity between a series of samples and then be able filter out spurious and other inconsistent noise signals between the series of samples.

Note the signals/vectors are mapped on the coordinate system reflective of the user's left and right ears to differentiate gravity and/or a tap verses noise generating events such as chewing, driving in a car, etc.

Figure 12I:
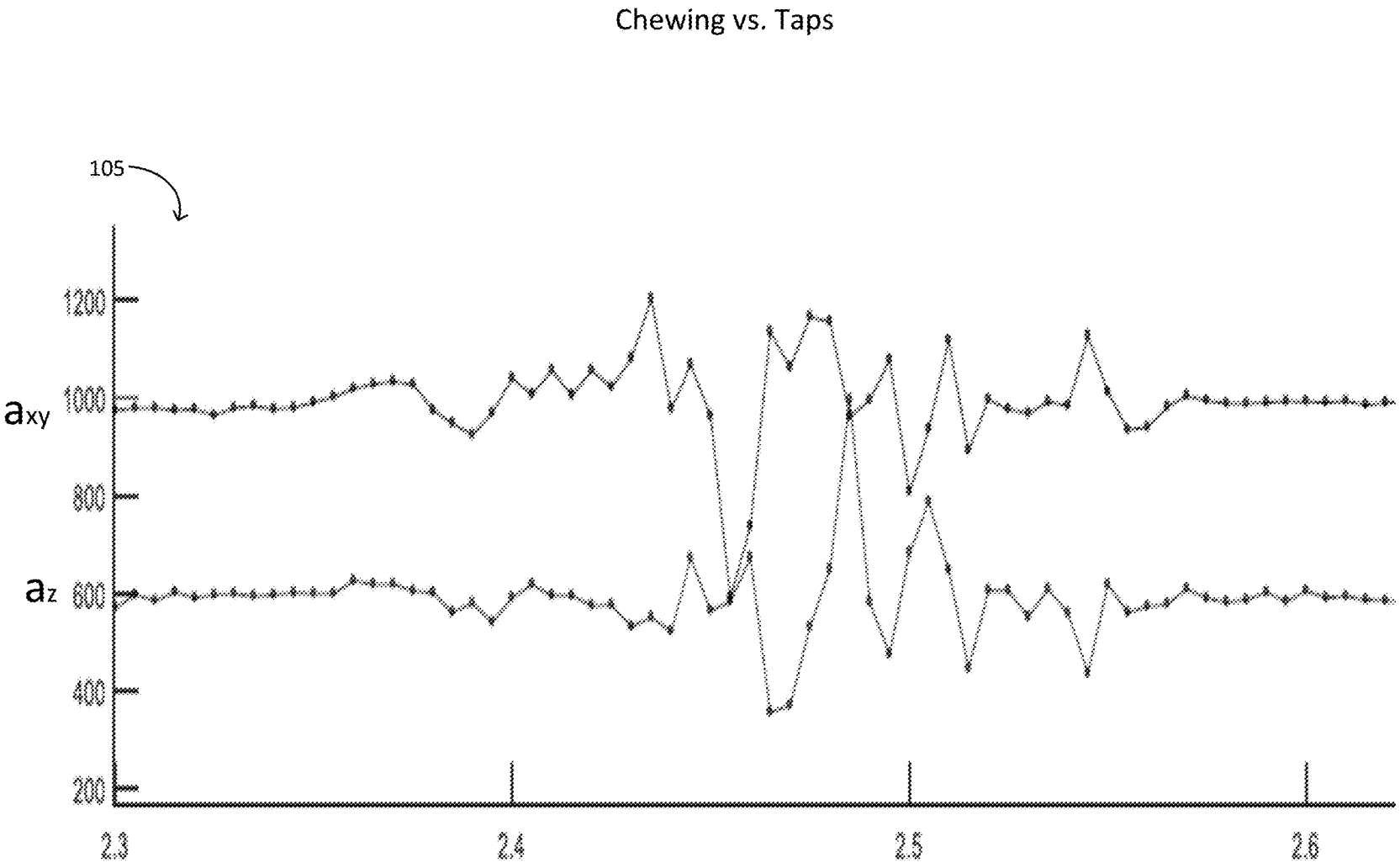

FIG. 12I illustrates an embodiment of a graph of vectors of an example hearing assistance device 105. The graph may vertically plot the magnitude, such an example scale 0 to 1200, and horizontally plot time, such as 2.3-2.6 seconds. The graph shows the vectors for Az and Axy from the accelerometer. In this example, the hearing assistance device 105 is installed in a right ear of the user and the user is remaining still sitting but chewing, e.g. a noise generating activity. A similar analysis can occur for a person remaining still sitting but driving a car and its vibrations. Taps can be differentiated from noise generating activities such as chewing and driving and thus utilize the filter to remove even these noise generating activities with some similar characteristics to taps. For one, taps on an ear or a mastoid seemed to always have a distinct rebound element with the initial spike; and thus, creating a typical spike pattern including the rebounds for a tap verses potential spike-like noise from a car or chewing.

The power control module can be configured to use a noise filter to filter out noise from a gravity vector coming out of the accelerometers. The noise filter may use a low pass moving average filter with periodic sampling to look for a relatively consistent vector coming out of the accelerometers due to gravity between a series of samples and then be able filter out spurious and other inconsistent noise signals between the series of samples.

Note the signals/vectors are mapped on the coordinate system reflective of the user's left and right ears to differentiate gravity and/or a tap verses noise generating events.

Figure 4:
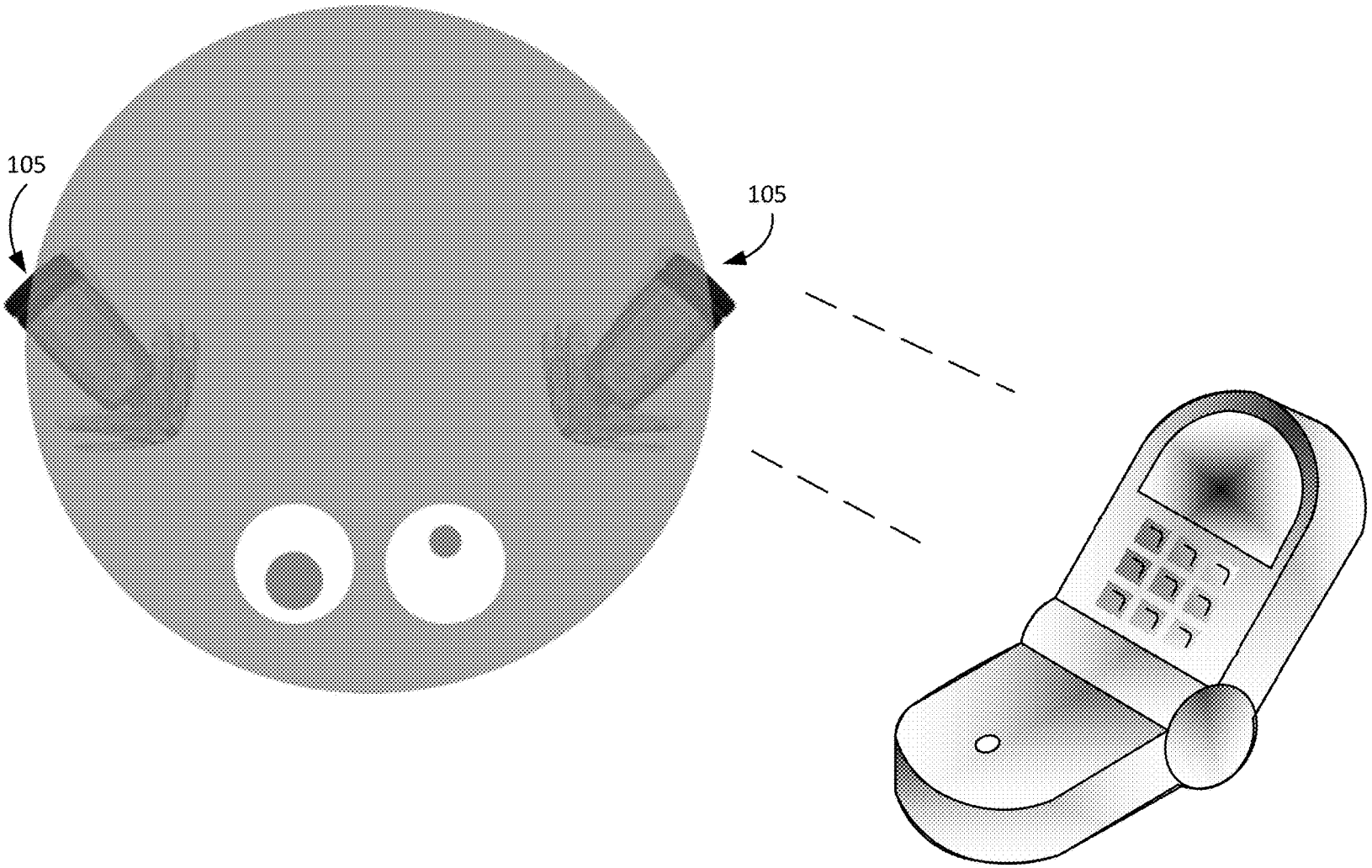
FIG. 4 illustrates an embodiment of block diagram of an example pair of hearing assistance devices each cooperating via a wireless communication module, such as Bluetooth module, to a partner application resident in a memory of a smart mobile computing device, such as a smart phone.

FIG. 4 illustrates an embodiment of block diagram of an example pair of hearing assistance devices each cooperating via a wireless communication module, such as Bluetooth module, to a partner application resident in a memory of a smart mobile computing device, such as a smart phone. FIG. 4 also shows a horizontal plane view of an example orientation of the pair of hearing assistance devices installed in a user's head.

The power control module in each hearing assistance device 105 can cooperate with a partner application resident on a smart mobile computing device. Also, the left/right determination module in each hearing assistance device 105 can cooperate with a partner application resident on a smart mobile computing device. The left/right determination module, via a wireless communication circuit, sends that hearing assistance device's sensed vectors to the partner application resident on a smart mobile computing device. The partner application resident on a smart mobile computing device may compare vectors coming from a first accelerometer in the first hearing assistance device to the vectors coming from a second accelerometer in the second hearing assistance device.

Network

FIG. 15 illustrates a number of electronic systems, including the hearing assistance device 105, communicating with each other in a network environment in accordance with some embodiments. Any two of the number of electronic devices can be the computationally poor target system and the computationally rich primary system of the distributed speech-training system. The network environment 700 has a communications network 720. The network 720 can include one or more networks selected from a body area network ("BAN"), a wireless body area network ("WBAN"), a personal area network ("PAN"), a wireless personal area network ("WPAN"), an ultrasound network ("USN"), an optical network, a cellular network, the Internet, a Local Area Network (LAN), a Wide Area Network (WAN), a satellite network, a fiber network, a cable network, or a combination thereof. In some embodiments, the communications network 720 is the BAN, WBAN, PAN, WPAN, or USN. As shown, there can be many server computing systems and many client computing systems connected to each other via the communications network 720. However, it should be appreciated that, for example, a single server computing system such the primary system can also be unilaterally or bilaterally connected to a single client computing system such as the target system in the distributed speech-training system. As such, FIG. 15 illustrates any combination of server computing systems and client computing systems connected to each other via the communications network 720.

The wireless interface of the target system can include hardware, software, or a combination thereof for communication via Bluetooth®, Bluetooth® low energy or Bluetooth® SMART, Zigbee, UWB or any other means of wireless communications such as optical, audio or ultrasound.

The communications network 720 can connect one or more server computing systems selected from at least a first server computing system 704A and a second server computing system 704B to each other and to at least one or more client computing systems as well. The server computing systems 704A and 704B can respectively optionally include organized data structures such as databases 706A and 706B. Each of the one or more server computing systems can have one or more virtual server computing systems, and multiple virtual server computing systems can be implemented by design. Each of the one or more server computing systems can have one or more firewalls to protect data integrity.

The at least one or more client computing systems can be selected from a first mobile computing device 702A (e.g., smartphone with an Android-based operating system), a second mobile computing device 702E (e.g., smartphone with an iOS-based operating system), a first wearable electronic device 702C (e.g., a smartwatch), a first portable computer 702B (e.g., laptop computer), a third mobile computing device or second portable computer 702F (e.g., tablet with an Android- or iOS-based operating system), a smart device or system incorporated into a first smart automobile 702D, a digital hearing assistance device 105, a first smart television 702H, a first virtual reality or augmented reality headset 704C, and the like. Each of the one or more client computing systems can have one or more firewalls to protect data integrity.

It should be appreciated that the use of the terms "client computing system" and "server computing system" is intended to indicate the system that generally initiates a communication and the system that generally responds to the communication. For example, a client computing system can generally initiate a communication and a server computing system generally responds to the communication. No hierarchy is implied unless explicitly stated. Both functions can be in a single communicating system or device, in which case, the first server computing system can act as a first client computing system and a second client computing system can act as a second server computing system. In addition, the client-server and server-client relationship can be viewed as peer-to-peer. Thus, if the first mobile computing device 702A (e.g., the client computing system) and the server computing system 704A can both initiate and respond to communications, their communications can be viewed as peer-to-peer. Likewise, communications between the one or more server computing systems (e.g., server computing systems 704A and 704B) and the one or more client computing systems (e.g., client computing systems 702A and 702C) can be viewed as peer-to-peer if each is capable of initiating and responding to communications. Additionally, the server computing systems 704A and 704B include circuitry and software enabling communication with each other across the network 720.

Any one or more of the server computing systems can be a cloud provider. A cloud provider can install and operate application software in a cloud (e.g., the network 720 such as the Internet) and cloud users can access the application software from one or more of the client computing systems. Generally, cloud users that have a cloud-based site in the cloud cannot solely manage a cloud infrastructure or platform where the application software runs. Thus, the server computing systems and organized data structures thereof can be shared resources, where each cloud user is given a certain amount of dedicated use of the shared resources. Each cloud user's cloud-based site can be given a virtual amount of dedicated space and bandwidth in the cloud. Cloud applications can be different from other applications in their scalability, which can be achieved by cloning tasks onto multiple virtual machines at run-time to meet changing work demand. Load balancers distribute the work over the set of virtual machines. This process is transparent to the cloud user, who sees only a single access point.

Cloud-based remote access can be coded to utilize a protocol, such as Hypertext Transfer Protocol (HTTP), to engage in a request and response cycle with an application on a client computing system such as a mobile computing device application resident on the mobile computing device as well as a web-browser application resident on the mobile computing device. The cloud-based remote access can be accessed by a smartphone, a desktop computer, a tablet, or any other client computing systems, anytime and/or anywhere. The cloud-based remote access is coded to engage in 1) the request and response cycle from all web browser based applications, 2) SMS/twitter-based requests and responses message exchanges, 3) the request and response cycle from a dedicated on-line server, 4) the request and response cycle directly between a native mobile application resident on a client device and the cloud-based remote access to another client computing system, and 5) combinations of these.

In an embodiment, the server computing system 704A can include a server engine, a web page management component, a content management component, and a database management component. The server engine can perform basic processing and operating system level tasks. The web page management component can handle creation and display or routing of web pages or screens associated with receiving and providing digital content and digital advertisements. Users (e.g., cloud users) can access one or more of the server computing systems by means of a Uniform Resource Locator (URL) associated therewith. The content management component can handle most of the functions in the embodiments described herein. The database management component can include storage and retrieval tasks with respect to the database, queries to the database, and storage of data.

An embodiment of a server computing system to display information, such as a web page, etc. is discussed. An application including any program modules, applications, services, processes, and other similar software executable when executed on, for example, the server computing system 704A, causes the server computing system 704A to display windows and user interface screens on a portion of a media space, such as a web page. A user via a browser from, for example, the client computing system 702A, can interact with the web page, and then supply input to the query/fields and/or service presented by a user interface of the application. The web page can be served by a web server, for example, the server computing system 704A, on any Hypertext Markup Language (HTML) or Wireless Access Protocol (WAP) enabled client computing system (e.g., the client computing system 702A) or any equivalent thereof. For example, the client mobile computing system 702A can be a wearable electronic device, smartphone, a tablet, a laptop, a netbook, etc. The client computing system 702A can host a browser, a mobile application, and/or a specific application to interact with the server computing system 704A. Each application has a code scripted to perform the functions that the software component is coded to carry out such as presenting fields and icons to take details of desired information. Algorithms, routines, and engines within, for example, the server computing system 704A can take the information from the presenting fields and icons and put that information into an appropriate storage medium such as a database (e.g., database 706A). A comparison wizard can be scripted to refer to a database and make use of such data. The applications can be hosted on, for example, the server computing system 704A and served to the browser of, for example, the client computing system 702A. The applications then serve pages that allow entry of details and further pages that allow entry of more details.

Example Computing systems

FIG. 16 illustrates a computing system that can be part of one or more of the computing devices such as the mobile phone, portions of the hearing assistance device, etc. in accordance with some embodiments. With reference to FIG. 16, components of the computing system 800 can include, but are not limited to, a processing unit 820 having one or more processing cores, a system memory 830, and a system bus 821 that couples various system components including the system memory 830 to the processing unit 820. The system bus 821 can be any of several types of bus structures selected from a memory bus or memory controller, a peripheral bus, and a local bus using any of a variety of bus architectures.

Computing system 800 can include a variety of computing machine-readable media. Computing machine-readable media can be any available media that can be accessed by computing system 800 and includes both volatile and nonvolatile media, and removable and non-removable media. By way of example, and not limitation, computing machine-readable media use includes storage of information, such as computer-readable instructions, data structures, other executable software or other data. Computer-storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other tangible medium which can be used to store the desired information and which can be accessed by the computing device 800. Transitory media such as wireless channels are not included in the machine-readable media. Communication media typically embody computer readable instructions, data structures, other executable software, or other transport mechanism and includes any information delivery media. As an example, some client computing systems on the network 220 of FIG. 16 might not have optical or magnetic storage.

The system memory 830 includes computer storage media in the form of volatile and/or nonvolatile memory such as read only memory (ROM) 831 and random access memory (RAM) 832. A basic input/output system 833 (BIOS) containing the basic routines that help to transfer information between elements within the computing system 800, such as during start-up, is typically stored in ROM 831. RAM 832 typically contains data and/or software that are immediately accessible to and/or presently being operated on by the processing unit 820. By way of example, and not limitation, FIG. 16 illustrates that RAM 832 can include a portion of the operating system 834, application programs 835, other executable software 836, and program data 837.

The computing system 800 can also include other removable/non-removable volatile/nonvolatile computer storage media. By way of example only, FIG. 16 illustrates a solid-state memory 841. Other removable/non-removable, volatile/nonvolatile computer storage media that can be used in the example operating environment include, but are not limited to, USB drives and devices, flash memory cards, solid state RAM, solid state ROM, and the like. The solid-state memory 841 is typically connected to the system bus 821 through a non-removable memory interface such as interface 840, and USB drive 851 is typically connected to the system bus 821 by a removable memory interface, such as interface 850.

The drives and their associated computer storage media discussed above and illustrated in FIG. 16 provide storage of computer readable instructions, data structures, other executable software and other data for the computing system 800. In FIG. 16, for example, the solid-state memory 841 is illustrated for storing operating system 844, application programs 845, other executable software 846, and program data 847. Note that these components can either be the same as or different from operating system 834, application programs 835, other executable software 836, and program data 837. Operating system 844, application programs 845, other executable software 846, and program data 847 are given different numbers here to illustrate that, at a minimum, they are different copies.

A user can enter commands and information into the computing system 800 through input devices such as a keyboard, touchscreen, or software or hardware input buttons 862, a microphone 863, a pointing device and/or scrolling input component, such as a mouse, trackball or touch pad. The microphone 863 can cooperate with speech recognition software on the target system or primary system as appropriate. These and other input devices are often connected to the processing unit 820 through a user input interface 860 that is coupled to the system bus 821, but can be connected by other interface and bus structures, such as a parallel port, game port, or a universal serial bus (USB). A display monitor 891 or other type of display screen device is also connected to the system bus 821 via an interface, such as a display interface 890. In addition to the monitor 891, computing devices can also include other peripheral output devices such as speakers 897, a vibrator 899, and other output devices, which can be connected through an output peripheral interface 895.

The computing system 800 can operate in a networked environment using logical connections to one or more remote computers/client devices, such as a remote computing system 880. The remote computing system 880 can be a personal computer, a hand-held device, a server, a router, a network PC, a peer device or other common network node, and typically includes many or all of the elements described above relative to the computing system 800. The logical connections depicted in FIG. 15 can include a personal area network ("PAN") 872 (e.g., Bluetooth®), a local area network ("LAN") 871 (e.g., Wi-Fi), and a wide area network ("WAN") 873 (e.g., cellular network), but can also include other networks such as an ultrasound network ("USN"). Such networking environments are commonplace in offices, enterprise-wide computer networks, intranets and the Internet. A browser application can be resident on the computing device and stored in the memory.

When used in a LAN networking environment, the computing system 800 is connected to the LAN 871 through a network interface or adapter 870, which can be, for example, a Bluetooth® or Wi-Fi adapter. When used in a WAN networking environment (e.g., Internet), the computing system 800 typically includes some means for establishing communications over the WAN 873. With respect to mobile telecommunication technologies, for example, a radio interface, which can be internal or external, can be connected to the system bus 821 via the network interface 870, or other appropriate mechanism. In a networked environment, other software depicted relative to the computing system 800, or portions thereof, can be stored in the remote memory storage device. By way of example, and not limitation, FIG. 16 illustrates remote application programs 885 as residing on remote computing device 880. It will be appreciated that the network connections shown are examples and other means of establishing a communications link between the computing devices can be used.

As discussed, the computing system 800 can include a processor 820, a memory (e.g., ROM 831, RAM 832, etc.), a built in battery to power the computing device, an AC power input to charge the battery, a display screen, a built-in Wi-Fi circuitry to wirelessly communicate with a remote computing device connected to network.

It should be noted that the present design can be carried out on a computing system such as that described with respect to FIG. 16. However, the present design can be carried out on a server, a computing device devoted to message handling, or on a distributed system such as the distributed speech-training system in which different portions of the present design are carried out on different parts of the distributed computing system.

Another device that can be coupled to bus 821 is a power supply such as a DC power supply (e.g., battery) or an AC adapter circuit. As discussed above, the DC power supply can be a battery, a fuel cell, or similar DC power source that needs to be recharged on a periodic basis. A wireless communication module can employ a Wireless Application Protocol to establish a wireless communication channel. The wireless communication module can implement a wireless networking standard.

In some embodiments, software used to facilitate algorithms discussed herein can be embodied onto a non-transitory machine-readable medium. A machine-readable medium includes any mechanism that stores information in a form readable by a machine (e.g., a computer). For example, a non-transitory machine-readable medium can include read only memory (ROM); random access memory (RAM); magnetic disk storage media; optical storage media; flash memory devices; Digital Versatile Disc (DVD's), EPROMs, EEPROMs, FLASH memory, magnetic or optical cards, or any type of media suitable for storing electronic instructions.

Note, an application described herein includes but is not limited to software applications, mobile apps, and programs that are part of an operating system application. Some portions of this description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. These algorithms can be written in a number of different software programming languages such as C, C+, or other similar languages. Also, an algorithm can be implemented with lines of code in software, configured logic gates in software, or a combination of both. In an embodiment, the logic consists of electronic circuits that follow the rules of Boolean Logic, software that contain patterns of instructions, or any combination of both.

It should be borne in mind, however, that all of these and similar terms are to be associated with the appropriate physical quantities and are merely convenient labels applied to these quantities. Unless specifically stated otherwise as apparent from the above discussions, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers, or other such information storage, transmission or display devices.

Many functions performed by electronic hardware components can be duplicated by software emulation. Thus, a software program written to accomplish those same functions can emulate the functionality of the hardware components in input-output circuitry.

While the foregoing design and embodiments thereof have been provided in considerable detail, it is not the intention of the applicant(s) for the design and embodiments provided herein to be limiting. Additional adaptations and/or modifications are possible, and, in broader aspects, these adaptations and/or modifications are also encompassed. Accordingly, departures can be made from the foregoing design and embodiments without departing from the scope afforded by the following claims, which scope is only limited by the claims when appropriately construed.

What is claimed is:

1. An apparatus, comprising:

a hearing assistance device having one or more accelerometers and a user interface configured to receive input data from the one or more accelerometers from user actions as sensed by the accelerometers to cause control signals to trigger a mode change for the hearing assistance device, and where a control module for the user interface is configured that after the hearing assistance device is powered on, then the control module uses signals from the accelerometers in order to eliminate undesired feedback, at least, when inserting the hearing assistance device into the user's ear.

2. The apparatus of claim 1, where the hearing assistance device is configured to use an algorithm that takes in signals from the accelerometers to turn off the device when stationary on a flat surface, which has a beneficial effect of eliminating audio feedback.

3. The apparatus of claim 1, where the hearing assistance device is an open-ear-canal hearing aid that includes i) an electronics portion to assist in amplifying sound for the user's ear and ii) a securing mechanism that has a flexible compressible mechanism connected to the electronics containing portion, where the flexible compressible mechanism is permeable to both airflow and sound to maintain an open ear canal throughout the securing mechanism.

4. The apparatus of claim 1, where the hearing assistance device further includes the accelerometers, a microphone, the control module with a digital signal processor, and a battery, where the control module is configured i) to use an input indicating a change in acceleration sensed by the accelerometers as well as ii) to use input data from one or more additional sensors including at least the microphone, where the hearing assistance device is configured to use a sensor combination of the input from the accelerometers and the input data from the microphone with the digital signal processor in order to convert these inputs into autonomous program changes for the hearing assistance device.

5. The apparatus of claim 1, where the hearing assistance device is configured to use the accelerometers coupled to a signal processor to use signals from the one or more accelerometers into its determination of both i) whether the hearing assistance device is moving, as indicated by a change of acceleration of the hearing assistance device, and ii) whether the hearing assistance device is installed in the user's ear as indicated at least by an evaluation of a gravity vector coming out of the accelerometers.

6. The apparatus of claim 1, where the one or more accelerometers and the control module are configured to receive input data indicating a change in acceleration of the hearing assistance device over time from the one or more accelerometers in order to make a determination to autonomously trigger the mode of the device based on whether the control module senses movement of the hearing assistance device as indicated by the accelerometers.

7. The apparatus of claim 1, where the hearing assistance device is configured to track an insertion state of the hearing assistance device in the user's ear by detecting no change in an orientation of the hearing assistance device after sensing a movement indicative of inserting the hearing assistance device.

8. The apparatus of claim 1, where the hearing assistance device is configured to track an insertion state of the hearing assistance device in the user's ear by vector data input from the accelerometers, and audio input from a microphone, and the control module, where the hearing assistance device is configured to combine the vector data input from the accelerometers in addition to the audio input from the microphone to determine the insertion state of the hearing assistance device in the user's ear.

9. The apparatus of claim 1, where the control module is configured to cooperate with the accelerometers to detect and register when a user removes the hearing assistance device from the user's ear, via a pattern of vectors coming from the accelerometers, where signals from the accelerometer are used to detect both a gravity vector and an output from the accelerometer indicative of movement of the hearing assistance device.

10. The apparatus of claim 1, where the hearing assistance device is configured to contain a wireless communication module to cooperate via the wireless communication module with a partner application resident in a memory of a smart mobile computing device.

11. A method for a hearing assistance device, comprising:

configuring the hearing assistance device having one or more accelerometers and a user interface to receive input data from the one or more accelerometers from user actions as sensed by the accelerometers to cause control signals to trigger a mode change for the hearing assistance device; and configuring a control module for the user interface that after the hearing assistance device is powered on, then the control module uses signals from the accelerometers in order to eliminate undesired feedback, at least, when inserting the hearing assistance device into the user's ear.

12. The method of claim 11, further comprising:

configuring the hearing assistance device to use an algorithm that takes in signals from the accelerometers to turn off the device when stationary on a flat surface, which has a beneficial effect of eliminating audio feedback.

13. The method of claim 11, further comprising:

configuring the hearing assistance device to be an open-ear-canal hearing aid that includes i) an electronics portion to assist in amplifying sound for the user's ear and ii) a securing mechanism that has a flexible compressible mechanism connected to the electronics containing portion, where the flexible compressible mechanism is permeable to both airflow and sound to maintain an open ear canal throughout the securing mechanism.

14. The method of claim 11, where the hearing assistance device further includes the accelerometers, a microphone, the control module with a digital signal processor, and a battery;

configuring the control module i) to use an input indicating a change in acceleration sensed by the accelerometers as well as ii) to use input data from one or more additional sensors including at least the microphone; and configuring the hearing assistance device to use a sensor combination of the input from the accelerometers and the input data from the microphone with the digital signal processor in order to convert these inputs into autonomous program changes for the hearing assistance device.

15. The method of claim 11, further comprising:

configuring the hearing assistance device to use the accelerometers coupled to a signal processor to use signals from the one or more accelerometers into its determination of both i) whether the hearing assistance device is moving, as indicated by a change of acceleration of the hearing assistance device, and ii) whether the hearing assistance device is installed in the user's ear as indicated at least by an evaluation of a gravity vector coming out of the accelerometers.

16. The method of claim 11, further comprising:

configuring the one or more accelerometers and the control module to receive input data indicating a change in acceleration of the hearing assistance device over time from the one or more accelerometers in order to make a determination to autonomously trigger the mode of the device based on whether the control module senses movement of the hearing assistance device as indicated by the accelerometers.

17. The method of claim 11, further comprising:

configuring the hearing assistance device to track an insertion state of the hearing assistance device in the user's ear by detecting no change in an orientation of the hearing assistance device after sensing a movement indicative of inserting the hearing assistance device.

18. The method of claim 11, further comprising:

configuring the hearing assistance device to track an insertion state of the hearing assistance device in the user's ear by vector data input from the accelerometers, and audio input from a microphone, and the control module, where the hearing assistance device is configured to combine the vector data input from the accelerometers in addition to the audio input from the microphone to determine the insertion state of the hearing assistance device in the user's ear.

19. The method of claim 11, further comprising:

configuring the control module to cooperate with the accelerometers to detect and register when a user removes the hearing assistance device from the user's ear, via a pattern of vectors coming from the accelerometers, where signals from the accelerometer are used to detect both a gravity vector and an output from the accelerometer indicative of movement of the hearing assistance device.

20. The method of claim 11, further comprising:

configuring the hearing assistance device to contain a wireless communication module to cooperate via the wireless communication module with a partner application resident in a memory of a smart mobile computing device.

* * * * *